US008985727B2

(12) United States Patent
Kido

(10) Patent No.: US 8,985,727 B2
(45) Date of Patent: Mar. 24, 2015

(54) INKJET PRINTING APPARATUS

(71) Applicant: Canon Kabushiki Kaisha, Tokyo (JP)

(72) Inventor: Hideyuki Kido, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/176,605

(22) Filed: Feb. 10, 2014

(65) Prior Publication Data

US 2014/0152738 A1 Jun. 5, 2014

Related U.S. Application Data

(63) Continuation of application No. 13/357,831, filed on Jan. 25, 2012, now Pat. No. 8,702,194.

(30) Foreign Application Priority Data

Jan. 31, 2011 (JP) ..... 2011-018947

(51) Int. Cl.
*B41J 29/38* (2006.01)
*B41J 11/00* (2006.01)
*B41J 2/21* (2006.01)

(52) U.S. Cl.
CPC ..... *B41J 11/0065* (2013.01); *B41J 2/2146* (2013.01)
USPC ..... 347/16; 347/19

(58) Field of Classification Search
CPC ..... B41J 11/0065; B41J 2/146
USPC ..... 347/5, 9, 14, 16, 19, 101, 104
See application file for complete search history.

(56) References Cited

U.S. PATENT DOCUMENTS

| | | | | |
|---|---|---|---|---|
| 6,840,691 | B2 * | 1/2005 | Isono et al. | 347/16 |
| 7,334,859 | B2 | 2/2008 | Kojima | |
| 7,525,674 | B2 * | 4/2009 | Otani et al. | 347/14 |
| 7,533,956 | B2 * | 5/2009 | Hatanaka et al. | 347/21 |

FOREIGN PATENT DOCUMENTS

| | | | |
|---|---|---|---|
| JP | 10-000764 | A | 1/1998 |
| JP | 2006-069028 | A | 3/2006 |
| JP | 2006-205742 | A | 8/2006 |

OTHER PUBLICATIONS

Office Action mailed Sep. 24, 2014, in Japanese Patent Application No. 2011-018947, Japanese Patent Office.

* cited by examiner

*Primary Examiner* — Juanita D Jackson
(74) *Attorney, Agent, or Firm* — Fitzpatrick, Cella, Harper & Scinto

(57) ABSTRACT

An inkjet printing apparatus is provided that can establish a test pattern detection region according to the printing format, where performing printing by way of a margined printing and a marginless printing is possible. The inkjet printing apparatus detects the position of both ends of the test pattern. In the case of a margined printing, a detection of the ink ejection status is performed with respect to ejection ports that perform printing at a region between both ends of the margined test pattern, and that eject the ink forming the pixels of the margined test pattern. In the case of a marginless printing, a detection of the ink ejection status is performed with respect to ejection ports that perform printing at a region between both ends of the marginless test pattern, and that eject the ink forming the pixels of the marginless test pattern.

32 Claims, 13 Drawing Sheets

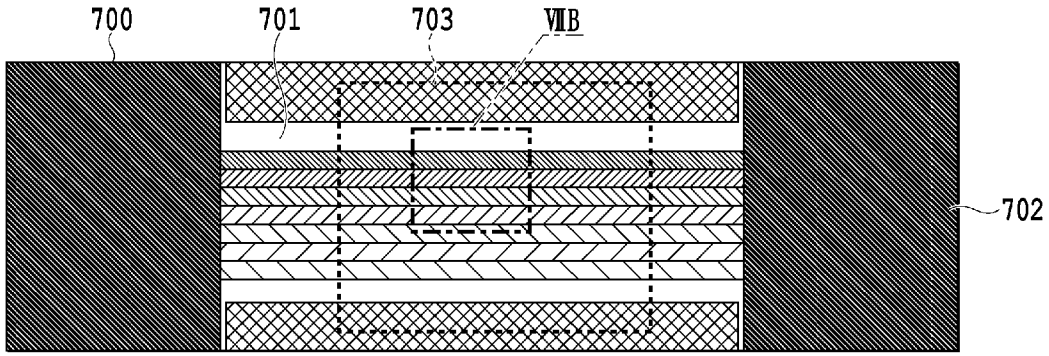
FIG.7A
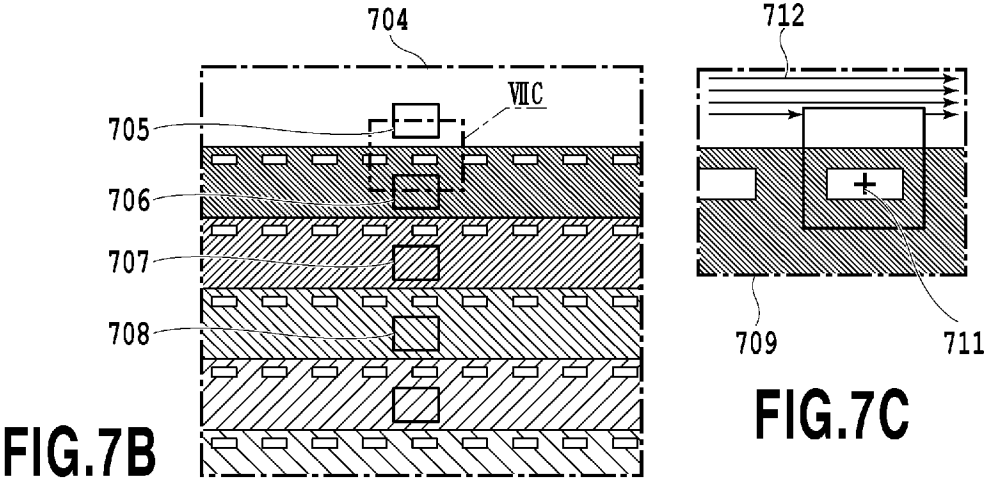
FIG.7B
FIG.7C
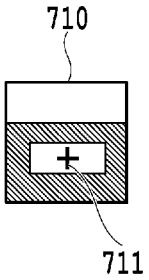
FIG.7D

INKJET PRINTING APPARATUS

This application is a continuation of U.S. patent application Ser. No. 13/357,831, filed on Jan. 25, 2012, now U.S. Pat. No. 8,702,194.

BACKGROUND OF THE INVENTION

1. Field of the Invention

The invention relates to full line type inkjet printing apparatuses, and in particular to inkjet printing apparatuses that detect the ejection state of ink ejected from the ejection ports of a print head.

2. Description of the Related Art

Inkjet type printing apparatuses are known in the art. Such inkjet printing apparatuses form characters and images by ejecting ink from ejection ports and fixing it onto a print medium. Among inkjet printing apparatuses, full line type inkjet printing apparatuses have been employed in recent years, which have a print head provided with an ejection port array corresponding to the printing width, and perform printing while conveying the print medium. Full line type inkjet printing apparatuses are becoming wider in use because of their ability to speedup printing. With respect to such full line type inkjet printing apparatuses, there are apparatuses that perform margined printing, in which printing is performed while establishing a margin along the edges of the print medium (the edges along the widthwise direction), and marginless printing, in which printing is performed without establishing a margin.

There are times where, for various reasons, the ejection of ink from an ejection port is in an unsatisfactory state. In the case where the ejection of ink is in an unsatisfactory state, there are times when it is necessary to perform measures such as to stop ink ejection from the ejection port and instead eject ink from a separate ejection port. As such times it is necessary to detect the position of the ejection port having an unsatisfactory ejection state.

As a method for detecting detection ports having an unsatisfactory ink ejection state, a method is known wherein a test pattern is printed on the print medium and ejection ports having an unsatisfactory ink ejection state are detected from the test pattern image. For example, a full line type inkjet printing apparatus, in which a print head is capable of performing printing across the entire widthwise direction of the print medium, and having a printing means for performing printing on the printing medium and a sensor for reading a printed test pattern, is disclosed in Japanese Patent Application Laid-Open No. 2006-205742. By way of the test pattern being read by a sensor, in the case where an ejection port having an unsatisfactory ejection state occurs on the print head, it is possible to detect the ejection port having an unsatisfactory ejection state by way of the test pattern being detected. In particular, in Japanese Laid-Open Publication No. 2006-205742, in the case where a marginless printing is performed that carries out printing such that a margin is not generated at the outer ends of the print medium (the outer ends in the width direction), ejection ports having an unsatisfactory ink ejection state are detected by way of the test pattern being detected. As for the inkjet printing apparatus disclosed in Japanese Laid-Open Publication No. 2006-205742, in the case where marginless printing is performed, ejection ports having an unsatisfactory ink ejection stare are detected by using a test pattern that is printed such as to cross the entire width of the print medium.

In the case where a marginless printing is performed, the printed image is formed longer than the print medium in the widthwise direction of the print medium, such as to run off of the edge of the print medium. On the other hand, in the case where a margined printing is performed, the printed image is printed on a portion of the print medium such as to reside within the print medium along its widthwise direction. Because of this, a portion of the ejection ports that are used when performing a marginless printing occur that are not used in the case of performing margined printing. Thus the region of used nozzles on the print head differs between the case where printing is performed by a margined printing and the case where printing is performed by a marginless printing. Because of this, the necessary test pattern region differs between the case where margined printing is performed and the case where marginless printing is performed, when printing a test pattern and detecting ejection ports having an unsatisfactory ejection state, from the test pattern. In this manner, in inkjet printing apparatuses capable of performing margined printing and marginless printing, the detection region on the test pattern, at the time of performing the detection of ejection ports having an unsatisfactory ink ejection state from the test pattern, is unfixed.

When the ejection ports used when printing a test pattern have been made to correspond to the ejection ports used in margined printing, when a marginless printing is performed there are times where ejection ports occur, at a section of the ejection ports within the print head, at which it is not possible to detect whether the ink ejection state is satisfactory. And when the ejection ports used when printing a test pattern have been made to correspond to the ejection ports used in marginless printing, when a margined printing is performed there are times where it is not possible to detect whether the ink ejection state is satisfactory, with respect to the ejection ports that are not used in printing. Because of this it is not possible to establish the range of ejection ports, within the print head, which should be set as the region at which detection of whether the ink ejection state is satisfactory is performed.

SUMMARY OF THE INVENTION

Accordingly, taking into account the above considerations, an object of the invention is to provide an inkjet printing apparatus that can establish a test pattern detection region according to printing format, in the case where performing printing by way of a margined printing and a marginless printing is possible.

According to an aspect of the present invention, there is provided an inkjet printing apparatus capable of performing printing by ejecting ink onto a print medium from a plurality of ejection ports arranged along a direction crossing the conveyance direction of the print medium, while conveying the print medium, such as to enable printing across the entire area of the print medium, capable of performing a margined printing that performs printing while forming a margin on an edge of the print medium, the edge being an end of the path in which the ejection ports are aligned, and capable of performing a marginless printing that performs printing without providing a margin on the edge of the print medium, the edge being an end of the path in which the ejection ports are aligned, comprising: a print mode setting unit that sets a printing mode, for when printing is performed, from among a margined print mode that performs printing by the margined printing and a marginless print mode that performs printing by the marginless printing; a margined test pattern end detection unit that detects the position of both ends of a margined test pattern printed by the ejection of ink from ejection ports used when performing printing in the margined printing mode; a marginless test pattern end detection unit that detects the position of both ends of a marginless test pattern printed by the ejection of ink from ejection ports used when performing printing in the marginless printing mode; a margined printing ejection state detection unit that performs, from the margined test pattern, the detection of the ink ejection state, with respect to ejection ports that perform printing at the region between both ends of the margined test pattern detected by the margined test pattern end detection unit and that ejects the ink that forms the pixels on the margined test pattern; and a marginless printing ejection state detection unit that performs, from the marginless test pattern, the detection of the ink ejection state, with respect to ejection ports that perform printing at the region between both ends of the marginless test pattern detected by the marginless test pattern end detection unit and that ejects the ink that forms the pixels on the marginless test pattern.

According to the invention it is possible to provide an inkjet printing apparatus that can perform a detection process for ejection ports having an unsatisfactory ink ejection state, at a region that depends on the ejection ports used in margined printing and marginless printing.

Further features of the invention will become apparent from the following description of exemplary embodiments (with reference to the attached drawings)

BRIEF DESCRIPTION OF THE DRAWINGS

FIGS. 7A to 7D are plan views for explaining the detection process that detects the test pattern used at the marginless printing caused by the inkjet printing apparatus of FIG. 1, and the detection mark detection process;

DESCRIPTION OF THE EMBODIMENTS

Preferred embodiments of the invention will be described below while referring to the accompanying drawings.

Figure 1:
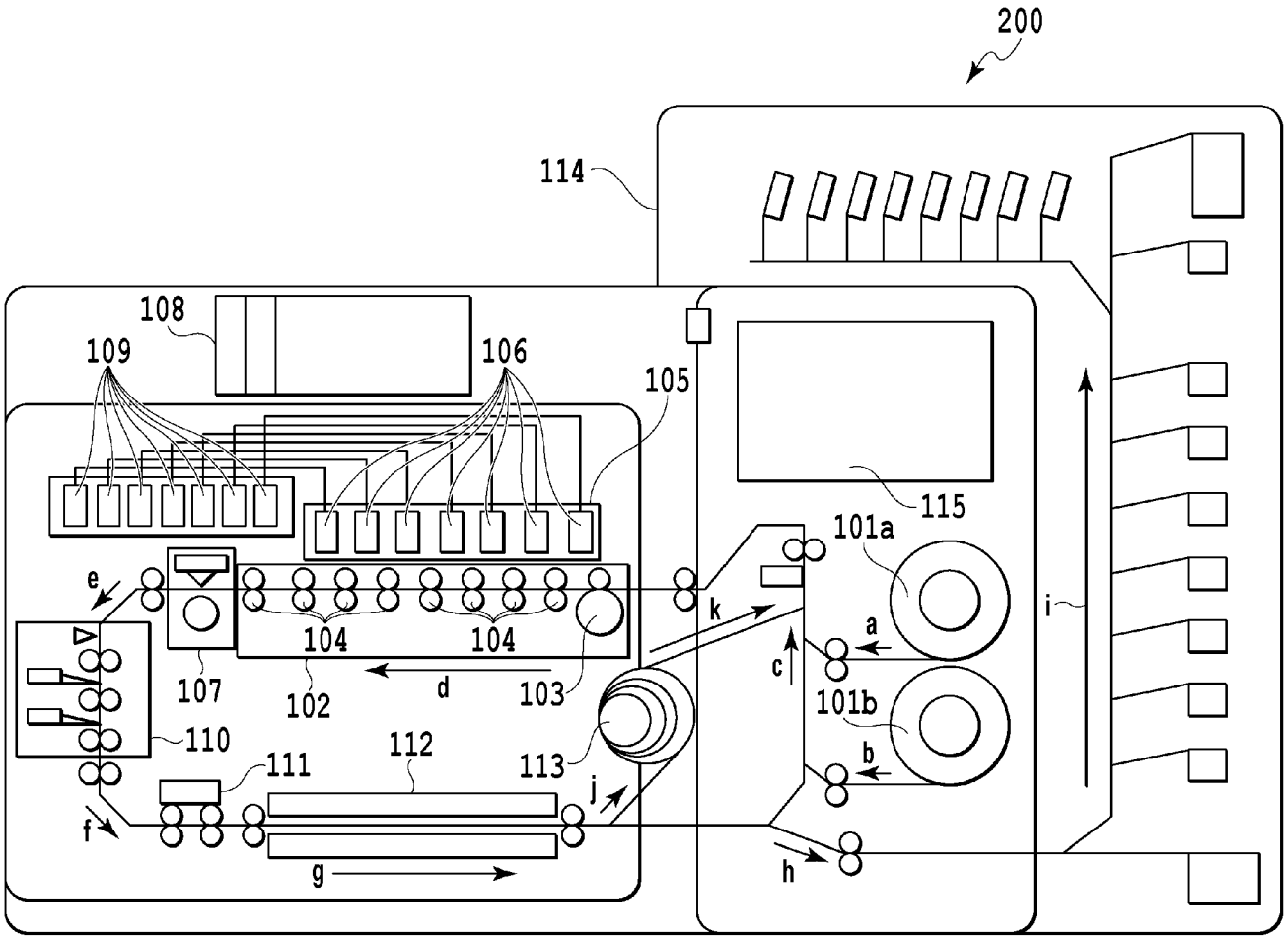
FIG. 1 is a cross sectional view that schematically illustrates the configuration of the inkjet printing apparatus of an embodiment of the invention.

FIG. 1 is a diagram that schematically illustrates the general structure of the inkjet printing apparatus 200 of an embodiment of the invention. Note that the embodiments below are provided as examples and are not intended to limit the scope of the invention.

The inkjet printing apparatus 200 performs printing by ejecting ink onto a print medium while conveying the print medium. The inkjet printing apparatus has a print head 106 that has multiple ejection ports arranged along a direction crossing the conveyance direction of the print medium, such as to be able to print across the entire region of the print medium. The inkjet printing apparatus 200 is a full-line type inkjet printing apparatus that performs printing by ejecting ink from such a print head onto a print medium. The inkjet printing apparatus 200 of this embodiment is capable of performing margined printing, in which printing is performed with a margin formed at the ends (in the direction in which the print head 106 extends) of the print medium, and is capable of performing marginless printing in which printing is performed without establishing a margin at the edge portions (of the direction in which the print head extends). In this embodiment the face of the print medium on which printing is carried out is white.

The ink jet printing apparatus 200 is provided with a printing facility that performs printing on a print medium, and a reading apparatus that reads an image printed on the print medium. In this embodiment a roll sheet (a continuous sheet that is longer than the length of a printing unit (1 page) in the conveyance direction) is used as the printing medium (a printing sheet) on which a printing process is performed. The printing medium, however, is not limited to a roll shape, as long as it is a long continuous sheet on which the printing of a multiple page portion on the same surface can be performed continuously without cutting. Cutting of the continuous sheet may be done automatically by the inkjet printing apparatus 200, or may be done via a user carrying out an instruction by way of a manual operation. The material of the printing medium is also not limited to paper; all types of materials may be used as long it is possible to performing a printing process on them. The inkjet printing apparatus is also not limited to one that only performs printing on a continuous sheet; it may also be an inkjet printing apparatus that also is capable of performing printing on a cut sheet that is cut in advance to a predetermined size. The apparatus is also not limited to one that performs color printing using multiple colors of printing agent; it may also be an apparatus that performs black-color (including grey) monochrome printing. Also, the printing is not limited to the printing of visible images; it may also be a printing of an invisible image or an image which is difficult to visually confirm, and it may also be the printing of something outside of a general image, such as, for example, a wiring pattern, a physical pattern for the manufacture of parts, a DNA base sequence, etc. The invention can be applied to all types of printing apparatuses as long as the printing agent is capable of being applied to a print medium. Note also that, in the case where operation of the printing processes at the inkjet printing apparatus 200 of FIG. 1 are controlled by a command from an external device connected to the printing apparatus 200, this external device becomes the printing control apparatus.

The inkjet printing apparatus 200 includes the following structural elements 101 to 115, which are disposed inside a single casing. These structural elements, however, may be divided among a plurality of casing.

The control unit 108 houses a control component that is provided with a controller (including a CPU or a MPU), a user interface information output device (a device that generates display information, acoustical information, etc.) and various I/O interfaces, and governs all types of control over the entire ink jet printing apparatus 200.

The inkjet printing apparatus 200 is provided with 2 sheet cassettes, a upper level sheet cassette 101*a* and a lower level sheet cassette 101*b*, as a roll sheet unit. A user, after mounting a roll sheet (hereafter, "sheet") into the magazine, loads the sheet into the inkjet printing apparatus main body. The sheet withdrawn from the upper level sheet cassette 101*a* is conveyed along the direction in the figure marked by the arrow a, and the sheet withdrawn from the lower level sheet cassette 101*b* is conveyed along the direction in the figure marked by the arrow b. The sheets from both of the cassettes advance along the direction in the figure marked by the arrow c, and arrive at the conveyance unit 102. During the printing process, the conveyance unit 102 conveys the sheet along the direction in the figure marked by the arrow d (the horizontal direction), through the multiple revolving rollers 104. When switching over from one feeding source sheet cassette to the other, a sheet that has already been drawn out is wound back inside the cassette, and a sheet is newly fed from a set cassette.

The print head unit 105 is disposed above and faces the conveyance unit 102. At the print head unit 105 independent print heads 106 corresponding to the plurality of colors (in this embodiment, 7 colors) are held along the direction in which the sheet is conveyed. In this embodiment the inkjet printing apparatus 200 has 7 print heads corresponding to 7 colors; K (black), M (magenta), C (cyan), Y (yellow), G (grey), LM (light magenta) and LC (light cyan). Of course, colors other than these may be used, and there is no necessity of using all of them. The inkjet printing apparatus 200 of this embodiment forms an image on a sheet by ejecting ink from the print heads 106 synchronously with the conveyance of the sheet caused by the conveyance unit 102. Note that the print heads are disposed at locations such that ejection destinations do not overlap with the revolving rollers 104. Instead of directly ejecting ink onto the sheet, after applying ink onto an intermediate transfer body, an image is formed via that ink being transferred to the sheet. In this case, from a test pattern printed on the print medium through the intermediate transfer body, detection may be performed with respect to the ejection ports for ejecting and applying ink onto the intermediate transfer body.

A print unit is configured to include a conveyance unit 102, a print head unit 105 and a print head 106 such as those described above. In the ink tanks 109 ink of each of the colors are independently stored. Ink is supplied by tubes to sub ink tanks that are established such as to correspond to each of the ink colors, and ink is supplied by tubes from the sub ink tanks to each of the print heads 106. The print heads 106 are line heads on which ejection ports are arranged in a line. Regarding the print heads 106, ejection ports are arranged along the d direction, the conveyance direction at the time of printing, and ejection port arrays corresponding to each of the colors are arranged such as to eject each color of ink (in this embodiment, 7 colors). The line heads of each color may be formed seamlessly on a single chip, or may be such that divided ejection port chips are systematically lined up in a row or a staggered alignment. As for this embodiment, as stated above, the inkjet printing apparatus 200 has full line type print heads 106.

Methods that use heat generation elements, methods that use piezoelectric elements, methods that use electrostatic elements, and methods that use MEMS elements, for example, may be used as the inkjet method for ejecting ink from the ejection ports. When performing printing, ink is ejected from ejection ports in each head based on print data. Ejection timing is determined by a signal output by the conveyance encoder 103.

After an image has been formed on a sheet, the sheet is conveyed from the conveyance unit 102 to the scanner unit 107. At the scanner unit 107, the image printed on the sheet and a special pattern are optically read and thereby it is determined whether there is a problem with the printed image, and confirmation of the status of the main body, including the ink ejection status, etc. is also carried out. In this embodiment a test pattern print image is read, and by way of performing an analysis with respect to the read test pattern image the ink ejection state of the ejection ports are determined. With respect to ejection state confirmation the apparatus may also be, however, one that performs a determination of whether printing was successful by way of performing a comparison between a read test pattern image and an image printed in advance. The confirmation method may be appropriately chosen from among a variety of methods.

The sheet is conveyed from the vicinity of the scanner unit 107, along the direction indicated by the e arrow, and is brought into the cutter unit 110. At the cutter unit 110 the sheet is cut at unit length intervals corresponding to a predetermined printing region. The length of this unit area, which corresponds to a predetermined printing region, differs according to the size of the printed image. For example, in the case of a L-sized photograph the sheet is cut at a conveyance direction length of 135 mm, and in the case of a A4 size the sheet is cut at a conveyance direction length of 297 mm. In the case of one-sided printing the cutter unit 110 cuts sheets in units corresponding to a page, however, there are also cases where it does not cut sheets in units corresponding to a page, depending on the contents of the print job.

The cutter unit 110 may also, in the case where double-sided printing is performed, successively print on a first side (for example, the front side) a portion of an image that corresponds to a predetermined length, and printing a second side (for example, the back side), cut the sheet a distance corresponding to a page unit. In this manner the sheet may not be cut at every page when printing has been performed on the first side of the sheet. Note the cutter unit 110 is not limited to an apparatus that cuts at 1 page image intervals when performing one-sided printing or the printing of the back side of a double-sided printing. The cutter unit 110 may also be an apparatus in which, without cutting until the sheet has been conveyed a predetermined length, the sheet is cut after it has been conveyed the predetermined length, and the separation into 1 page image intervals is a cutting performed at a separate cutting apparatus via a manual operation, etc. As well, in the case where cutting is necessary in the width direction of the sheet cutting is performed using a separate cutting apparatus.

The sheet that has been conveyed from the cutter unit 110 is conveyed inside the unit in the direction of the f arrow of the figure, and conveyed to the back side printing unit 111. The back side printing unit 111, in the case of printing an image on one side of the sheet only, is a unit for causing predetermined information to be printed on the back side of the sheet. Character, signal, and code information (for example, an order management number, etc.), corresponding to each print image, are included among information printed on the back side of the sheet. The back side printing unit 111, in the case where the print head 106 prints an image for a double-sided printing job, may print information, such as that mentioned above, outside of the region at which the print head 106 prints an image. In this embodiment ink jet printing methods are also used at the back side printing unit 111.

The sheet that has passed through the back side printing unit 111 is subsequently conveyed to the drying unit 112. The drying unit 112, in order to dry the sheet on which ink has been applied in a short time interval, is a unit that heats, with hot wind (a gas (air) that has had its temperature raised), a sheet passing along the direction indicated by the g arrow of the figure. Note that in addition to using hot wind as the drying method various other means may also be used, such as cold wind, increasing the temperature by a heater, natural drying by way of waiting alone, bombardment with ultraviolet light electromagnetic waves, etc. As for the pages that have been separated into page interval unit lengths, they pass into the drying unit 112 a page at a time, and conveyed along the direction indicated by the h arrow of the figure to the sorting unit 114. The sorting unit 114 holds a plurality of trays (in the case of this embodiment 18 trays) and classifies discharge tray destination according to page interval unit length, etc. A tray number is allocated to each tray. For each type of print image, the sorting unit 114 discharges sheets passing inside the unit along the direction marked by the i arrow of the figure into trays corresponding to set tray numbers, while confirming by sensors provided on each tray whether the tray has a vacancy or is fully-loaded. As for the tray that becomes the discharge destination of a cut sheet, there are cases where a particular tray is specified at the point of origin of the print job (the host device), and there are cases where an open tray is arbitrarily specified at the inkjet printing apparatus side. A single tray is capable of handling discharge up to a number of pages set in advance. In the case where a print job exceeds the number of pages set in advance, discharge is spread out among multiple trays. With respect to the trays, the number of sheets, and sheet size, that are capable of being discharged differ according to the size (type) of tray, etc. In FIG. 1 the trays that are aligned vertically (up and down) (hereafter, "large trays") are capable of handling discharge of large size sheets (a size larger than the (photograph) L-size, such as A4) and small size sheets (photograph L-size). The horizontally (left to right) aligned trays (hereafter, "small trays") are capable of handling the discharge of small size (photograph L-size) sheets but are not capable of handling the discharge of large size sheets. The number of sheets that are capable of being output are greater at the large trays than at the small trays. Status information indicating whether the apparatus is in the process of discharging sheets or whether discharge has been completed is made discernable to a user by employing a display device (for example, by using a LED, etc.). For example, it is possible to establish on each tray multiple lights that generate colors of light differing from each other and to notify a user of various tray statuses by way of the color of a lit LED, or the lit or blinking state of a LED, etc. It is possible to attach a preferential ranking to each of the multiple trays of the inkjet printing apparatus 200. The inkjet printing apparatus 200, when executing a print job, sequentially allocates open trays (trays where sheets are not present) as sheet discharge destinations according to the preferential ranking set in advance. The default setting of the inkjet printing apparatus 200 of this embodiment is such that among the large trays those that are higher in FIG. 1 are given a higher preferential ranking and such that among the small trays those that are further left in the figure are given a higher preferential ranking. Also, in this embodiment, the preferential rankings of the small trays are higher than the preferential rankings of the large trays. The preferential rankings of the trays can be set higher as the location becomes easier for the user to remove sheets, but is also capable of being appropriately changed by a user operation.

The sheet winding unit 113 performs the winding of a sheet the front surface of which has been printed without cutting at page intervals. In the case of one-sided printing, first, without cutting the sheet which has an image formed on its front side into a page unit, the sheet is cut by the cutter unit 110 after the printing on the continuous front side has been completed. The sheet with its front side printed passes inside the unit along the direction indicated by the j arrow of the figure, and is wound up by the sheet winding unit 113. Then, front side image formation of a consecutive page portion is completed, the side of the wound up sheet opposite the front side is made the side on which printing is possible, that is, the side facing the print head 106 is reversed, and the sheet is conveyed again along the direction of the unit indicated by the k arrow of the figure. Printing of an image on the back side, which is opposite the front side, is brought about by performing cutting of the sheet and conveyance of the print medium in the above manner. In the case of normal single-sided printing, the sheet on which an image is printed is conveyed to the sorting unit 114 without the performance of winding by the sheet winding unit 113.

As described above, in the case of double-sided printing winding of the sheet is performed using the sheet winding unit 113, and because the sheet is reversed and printing performed on its reverse side, the orientation of the sides of the sheets that are discharged to the sorting unit 114 differ when performing single-sided printing and double-sided printing. That is, because in the case of single-sided printing, reversal of the sheet using the sheet winding unit is not performed, the sheet on which the image of the first page is printed is discharged in a state where the image of the first page faces downward in FIG. 1. In the case where 1 print job is a job with multiple pages, a sheet is delivered to the tray starting with the sheet of the first page, the following pages are subsequently discharged in order, and the sheets are stacked. This type of discharge is referred to as face down discharge. On the other hand, because in the case of double-sided printing, reversal of the sheet using the sheet winding unit is performed, the sheet on which the image of the first page is printed is discharged in a state where the image of the first page faces upward. In the case where 1 print job is a job that performs the output of multiple sheets, a sheet is discharged to the tray starting from the sheet containing the last page, the sheets of lower-numbered pages are subsequently discharged in order, the sheets are stacked, and finally the sheet on which the image of the first page is printed is discharged. This type of discharge is referred to as face up discharge.

The operation unit 115 is a unit at which a user can perform various operations and at which various information can be notified to the user. For example, it is possible to confirm which tray the sheet on which the image specified by the user has been printed is loaded in, whether the image is in the process of being printed or whether printing of it has been completed, and the print status of each order. It is also possible for the user to perform operations and confirmations at the operation unit 115 in order to confirm the amount of remaining ink, the amount of remaining sheets and various device statuses, and to send an instruction to perform device maintenance such as head cleaning, etc.

Figure 2:
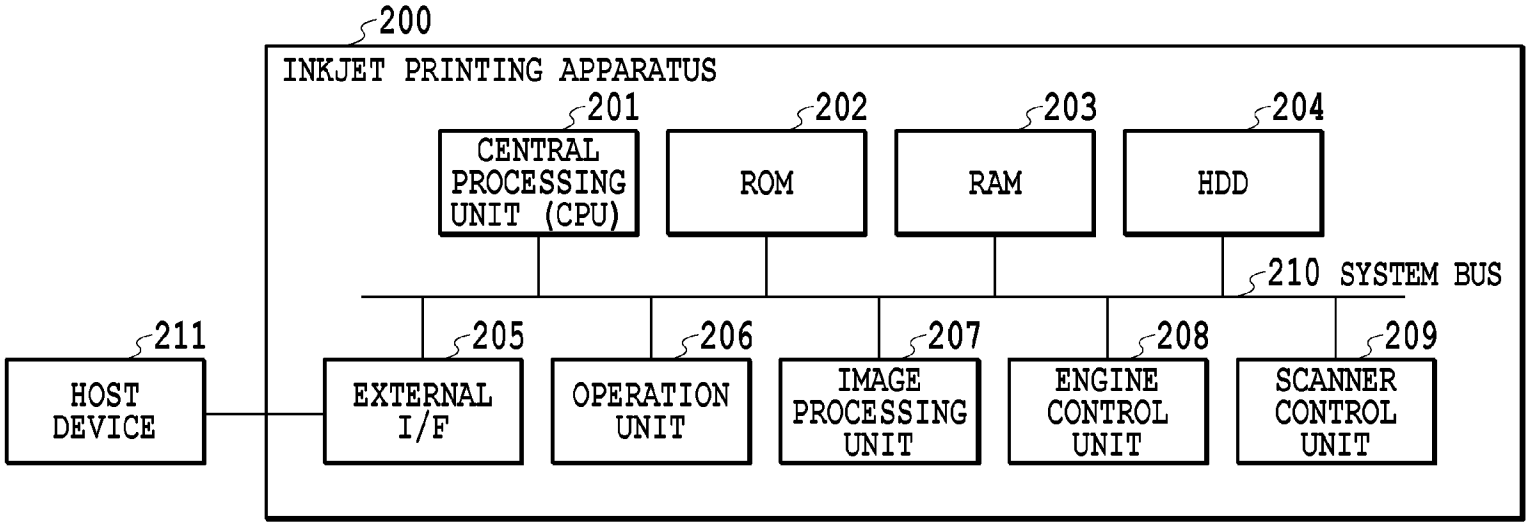
FIG. 2 is a block diagram for explaining the configuration concerning the control system of the inkjet printing apparatus of FIG. 1.

FIG. 2 is a block diagram for explaining the configuration relating to control at the inkjet printing apparatus 200 of the current embodiment, shown at FIG. 1. The CPU 201, the ROM 202, the RAM 203, the image processing unit 207, the engine control unit 208 and the scanner control unit 209 are primarily included in the control unit 108. The HDD 204, the operation unit 206, the external I/F 205, etc. are connected to the control unit 108 via the system bus 210.

The CPU 201 is a microprocessor (microcomputer) type central processing unit included in the control unit 108 of FIG. 1. The CPU 201 controls overall operations of the inkjet printing apparatus 200 by executing programs and activating hardware. The ROM 202 stores programs for execution by the CPU 201 as well as fixed data necessary for the various operations of the inkjet printing apparatus 200. The RAM 203 is used as a workspace for the CPU 201, is used as a temporary storage location for various received data, and records various types of set data. The HDD 204 is capable of writing to and reading from an internal hard disc programs for execution by the CPU 201, print data, and set information necessary for the various operations of the inkjet printing apparatus 200. Note that another high volume storage device may be substituted for the HDD 204.

The operation unit 206 contains a hard key and touch panel for the user to perform various operations and a display unit for the presentation (notification) of various information to a user, and corresponds to the operation unit 115 of FIG. 1. Presentation of information to a user may also be performed by outputting a sound (a buzzer, a voice, etc.) from a sound generation device based on acoustical information.

The image processing unit 207 performs development (conversion) and image processing of print data handled at the inkjet printing apparatus 200 (for example, data expressed as page description language) into image data (a bit map image). The color space (for example, YCbCr) of the image data contained in the input print data is converted into a standard RGB color space (sRGB for example). Various image processes are also applied to the image data as necessary, such as a resolution conversion to an effective number of pixels (a number of pixels that the inkjet printing apparatus 200 is capable of print processing), image analysis, image correction, etc. The image data obtained from these image processes are stored in the RAM 203 or the HDD 204.

The engine control unit 208 performs control over the process that prints an image on a sheet based on print data, according to control commands received from the CPU 201, etc. The engine control unit 208 also carries out the regulation, etc., of ink ejection commands to the print heads 106 of each color, the ejection timing settings for regulation of dot position on the print medium (the ink impact position) and obtaining status of driving by print head. Furthermore, the engine control unit 208 performs print head drive control in accordance with print data and forms images on the sheet by causing ink to be ejected from the print heads. The engine control unit 208 also carries out drive command over feed rollers, drive command over the conveyance rollers, and conveyance roller rotation status acquisition, etc., and along with performing conveyance roller control, conveys sheets at a suitable speed and path, as well as terminating the conveyance.

The scanner control unit 209 performs image sensor control according to control commands received from the CPU 201, etc, reads images on the sheet, acquires red (R), green (G), and blue (B) analog luminance data, and converts it to digital data. A CCD image sensor and a CMOS image sensor, etc., can be used as the image sensor. The image sensor may be a linear image sensor and it may also be an area image sensor. The scanner control unit 209 carries out image sensor drive command and performs image sensor status acquisition based on the driving of the image sensor. The luminance data acquired from the image sensor is analyzed and detection of ejection ports that are in a state wherein ejection of ink from its print head 106 is not satisfactory, and detection of the sheet cutting position are performed. Sheets at which it is determined by the scanner control unit 209 that an image has been correctly printed thereon are discharged to the specified sorting unit tray after a drying process has been applied to the ink on the sheet.

The host device 211 corresponds to the above described external device, is connected to the exterior of the ink jet printing apparatus 200 of this embodiment, and is an apparatus that is the supply source of image data (print data) for causing the inkjet printing apparatus 200 to print. The host device 211 issues various print job orders and transmits them to the inkjet printing apparatus 200. The host device 211 may be implemented as a general-use personal computer (PC) or another type of data supply apparatus. An image capture device that captures an image and generates image data is one such other type of data supply apparatus. An image capture device is, for example, a reader (scanner) that reads an image on the original and generates image data, or a film scanner that reads a negative or positive film and generates image data. As other examples of image capture devices there is a digital camera that photographs a still image and generates digital image data, and digital video recorder that records video and generates video image data. In addition it may be an apparatus that sets up photo storage on a network, provides a socket into which detachable portable memory is inserted, reads an image file stored in the photo storage on the portable memory, generates image data and prints. The host device 211 may be various data supply devices, such as a terminal specific to the ink jet printing device of this embodiment, instead of the general-use PC. These data supply devices may be structural elements of the inkjet printing apparatus or may be separate devices connected to the exterior of the inkjet printing apparatus. In the case where the host device 211 is a PC, an OS, application software that generates image data, and a printer driver for the inkjet printing apparatus 200 are installed in the recording apparatus of the PC. The printer driver controls the inkjet printing apparatus 200 of this embodiment, converts image data supplied from the application software into a form that can be handled by the inkjet printing apparatus 200, and generates print data. The image data may also be supplied to the inkjet printing apparatus 200 after performing the conversion from print data to image data at the host device 211 side. Note that it is not necessary to execute all of the above described processes with software; a portion or all of them may also be executed by hardware. Image data supplied from the host device 211 and other commands, as well as status signals, etc., are capable of being sent to and received by the inkjet printing apparatus 200 via the external I/F 205. The external I/F 205 may be a local I/F or a network I/F. The external I/F 205 may be connected by a wired or wireless connection.

Each of the above described structures inside the inkjet printing apparatus 200 are connected via the system bus 210 and are capable of communicating with each other.

Note that while in the above example a single CPU 201 controls all of the structural elements inside the inkjet printing apparatus 200 shown at FIG. 2, other configuration are also possible. That is, it is also possible to have an apparatus wherein a number of functional blocks each are provided with a separate CPU and are separately controlled by their respective CPU. Each of the function blocks may be suitably divided into separate processing units or control units, an apportionment other than that of the configuration shown at FIG. 2, and various configurations may be used, such as by combining several function blocks. DMAC (a Direct Memory Access Controller) may also be used for reading data out from memory.

Note that when carrying out printing the inkjet printing apparatus of this embodiment can be set, based on image data supplied from the host device 211, to a margined print mode that performs printing with a margin or to a marginless print mode that performs printing without a margin. Here, at the current embodiment, the CPU 201 functions as a print mode setting means that sets the print mode to the margined print mode or the marginless print mode.

Figure 3A:
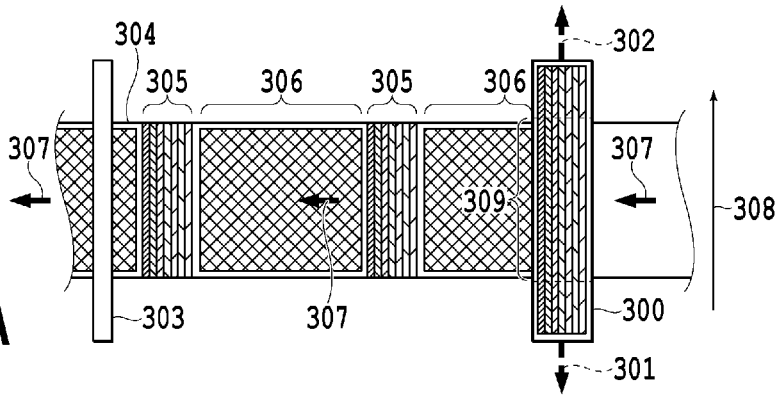
FIGS. 3A to 3C are plan views illustrating the print head of the inkjet printing apparatus of FIG. 1, the print medium, and a scanner unit.
Figure 3B:
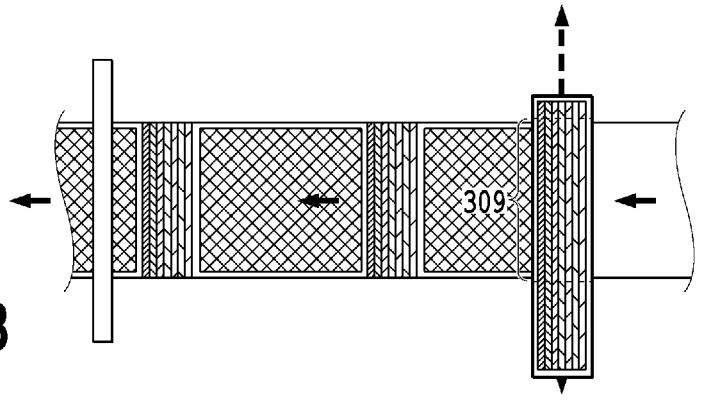
Figure 3C:
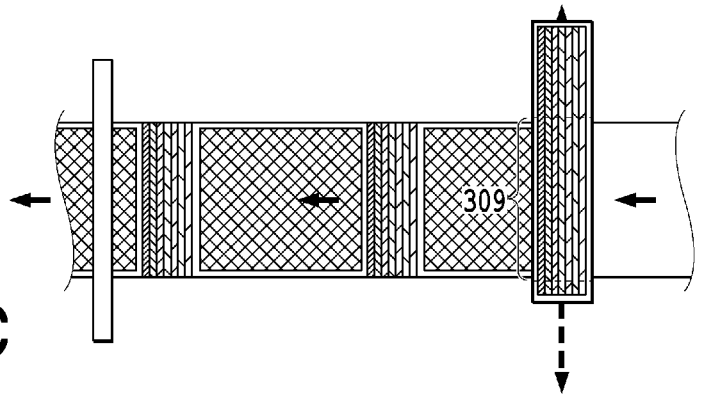

FIGS. 3A to 3C are diagrams for explaining the print medium and print head unit of the present embodiment, the position of the scanner unit, the print position of the test pattern, and the detection process that concerns whether or not there are ejection ports in an unsatisfactory printing state. In FIGS. 3A to 3C, an example is shown in which, using roll paper as the print medium 304, a test pattern 305, which is for the detection process concerning the presence of ejection ports having an unsatisfactory printing state onto the print medium 304, is printed. The print region 306 is a region of the print image that is printed for practical purposes via a print command from a user.

The arrow 307 indicates the direction in which the print medium 304 is conveyed. The direction of the arrow 307 is taken as the print medium conveyance direction.

The arrow 308 indicates alignment direction of the ejection ports of the print head. The direction of the arrow 308 is taken as the main scanning direction of the head.

The print head unit 300 is provided with multiple print heads. In this embodiment the print head unit 300 comprises 7 print heads. From the downstream side of the print medium conveyance direction the print heads correspond to 7 colors; K (black), M (magenta), C (cyan), Y (yellow), G (grey), LM (light magenta) and LC (light cyan).

The main scan movement directions 301 and 302 denote the movement direction when the print head unit 300 performs a main scan. FIG. 3A is a plan view of the print medium and the print head unit 300 in the case where ejection port region 309 in use is approximately the central portion of the print head unit 300. FIG. 3B is a plan view of the print medium and the print head unit when the print head unit 300 has been moved further in the main scan direction of movement 301 of the print head unit 300, than in the state shown at FIG. 3A. FIG. 3C is a plan view of the print medium and the print head unit 300 when the print head unit 300 has been moved further in the main scan direction of movement 302, than in the state shown at FIG. 3A. It is possible to restrain the usage rate of only a portion of the ejection ports of the print head unit from becoming high by moving the print head unit in the main scan movement directions 301 and 302 during the course of using the print head unit. The durability of the print head is improved because the printing operation is carried out such that a wide range of ejection ports on the print head unit are used dispersedly by way of the print head unit moving in the head main scanning direction. By way of causing the print head unit 300 to move in the main scan movement directions 301 and 302 it is possible to restrain bias in the usage amount of particular ejection ports. Thus, it is possible to reduce the generation of density level differences in printed images caused by bias in ejection port usage, and it is possible to reduce the influence on the print image caused thereby. After a test pattern has been printed and an ejection status detection process has been performed with respect to the ejection ports that printed the test pattern, movement of the print head in the main scanning direction is not performed until the printing at the position of the print head is completed. Each time movement in the main scanning direction is performed, printing of a test pattern is performed. For each print head position, an ejection status detection process is performed with respect to the ejection ports that printed the test pattern.

The scanner unit 303 is disposed, in relation to the print head unit 300, on the downstream side of the print medium conveyance direction. The scanner unit 303 reads the test pattern 305 printed on the print medium 304 in order to perform a detection process concerning the presence or absence of ejection ports on the print head unit 300 at which ink ejection is unsatisfactory.

The detection concerning the presence or absence of ejection ports at which the ejection is in an unsatisfactory state will be explained next. The detection concerning the presence or absence of ejection ports at which ejection is in an unsatisfactory state is performed by the test pattern 305 printed between the print regions 306 being read by the scanner unit 303 and by the image read from the test pattern 305 being analyzed. By this the inkjet printing apparatus determines the presence or absence of ejection ports on the print head with an unsatisfactory ejection state, such as ejection ports that do not perform the ejection of ink or ejection ports having low precision impact locations. In the present embodiment, in the case where it is determined that there are ejection ports having an unsatisfactory ejection state on the print head, without stopping the printing operation, substitute ink dropping by other ejection ports, that is, supplementary printing, is performed. Note that in the case where it is determined that there are ejection ports having an unsatisfactory printing state, with stopping the printing operation, it is possible for print head recovery control to be performed.

Here, as for the test pattern printed on the print medium, a test pattern is selected that is appropriate for the print mode of the job being executed at that time. When printing an image of a print job for which margined printing has been set at the inkjet printing apparatus, the test pattern is formed inside the range where the margined printing is carried out on the print medium. When printing an image of a print job for which marginless printing has been set, the test pattern is formed inside the range where the marginless printing is carried out on the print medium. In this way test patterns are formed according to the printing mode of the job at the time of performing printing. That is, in this embodiment, the inkjet printing apparatus 200 has a test pattern selection means that selects a test pattern to be printed on the print medium from among a margined test pattern and a marginless test pattern, in accordance with the print mode of the print job at the time of printing. In this embodiment the CPU 201 is functions as the test pattern selection means that selects the test pattern to be printed on the print medium from among a margined test pattern and a marginless test pattern.

For the case where ejection ports in a state where ink ejection is unsatisfactory are detected, the printing, in order to supplement the ejection ports in the state where ink ejection is unsatisfactory, will be explained next. Where ejection ports having an unsatisfactory ejection state are present on the print head, printing is not performed from those ejection ports at the region where printing should be performed because ink is not correctly ejected therefrom, and a blank space is undesirably generated as the print image. Hence a white stripe occurs, in the direction of conveyance, in the print image on the print medium, and the image quality of the print image decreases as a result. As for the supplementation of the ejection ports in an unsatisfactory ejection state, the ejection of ink is performed by way of the ink that should have been ejected from the ejection ports in an unsatisfactory ejection state being substituted for by other neighboring ejection ports. Due to this the reduction of print image quality caused by white stripes in the print image is reduced. In this embodiment the print head is configured to have 2 ejection port arrays. Accordingly, in this embodiment, in the printing for supplementing the ejection ports in an unsatisfactory ejection state, ink ejection is substituted by the ejection ports of another ejection port array that has its ejection ports at the same location along the alignment direction as the ejection ports having the unsatisfactory printing state. Note that, concerning printing for supplementation, in the case where the print head has more than 2 ejection port arrays, or in the case of a configuration provided with multiple print heads of the same color, substitution may be performed by a plurality of 3 or more ejection port arrays, and substitution may be performed by the ejection ports of a different print head. In order to reduce the influence of white stripes on the print image, substitute ink dropping by ejection ports of another color may also be performed, and substitute ink dropping by ejection ports of multiple colors may be performed.

FIGS. 4A to 4D are explanatory diagram for explaining the printing method of the test pattern of this embodiment. The test pattern 401 is printed by the print head unit 400 on the print medium, and is a test pattern for performing a detection of ejection ports on the print head unit 400 that are in an unsatisfactory ejection state. The arrow in the figure denotes the print medium conveyance direction.

Figure 4A:
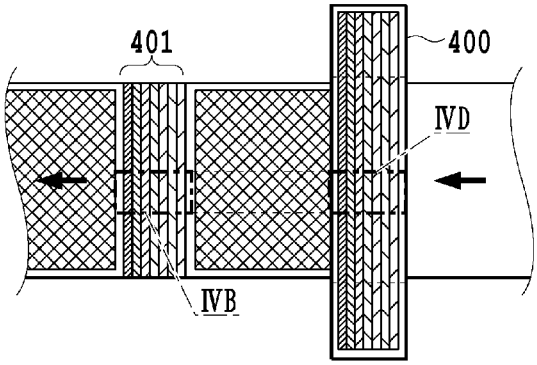
FIGS. 4A to 4D are views for explaining the test pattern printed on the print medium by the print head of FIGS. 3A to 3C.
Figure 4B:
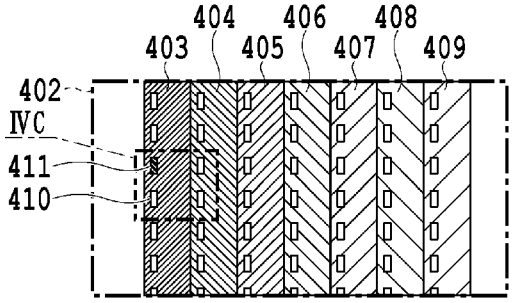

The test pattern 402 shown in FIG. 4B is an enlargement of a portion of the test pattern 401. Each of the test patterns 403 to 409 are test patterns that correspond to each print head and are for detecting ejection ports that have an unsatisfactory ejection state. The test patterns 403 to 409, are test patterns that respectively correspond to the print heads that each of the colors of ink, K (black), M (magenta), C (cyan), Y (yellow), G (grey), LM (light magenta) and LC (light cyan). Each of the test patterns 403 to 409 have the same form and are respectively printed from print heads corresponding to each color. The later described head position reference detection mark 411 is printed only at the test pattern 403. The detection mark 410 is formed at a region inside the test pattern by a void formed by leaving the color of the print medium as it is, without the dropping of ink. The detection marks 410 are formed into a rectangular shape by the print heads corresponding to the test patterns of the respective colors, and are printed at equally spaced intervals along the main scanning direction of the print head. The detection marks 410 are patterns for, when analyzing ejection ports in an unsatisfactory ejection state, for recognizing the relative positional relationship between the ejection ports of the print head and the respective pixels that form the test pattern. As described later, the test pattern image setup in advance and the actual test pattern image are compared, and it is possible to recognize the relative positional relationship between the ejection ports of the print heads and the print medium. When an ejection port having an unsatisfactory ink ejection state has been detected from the test pattern, by way of detecting the relative position from the head position reference detection mark 411, it is possible to recognize the position of the ejection port on the print head. The head position reference detection mark 411 is a pattern formed by solid printing at the region formed by a void, by the ejection of a print head of a color different than the color surrounding the void region. The head position reference detection mark 411 is a rectangular shaped pattern, similarly to the detection mark 410. The later described FIG. 11 will be used to explain in detail the arrangement of the head position reference detection mark 411 on the test pattern 401.

Figure 4C:
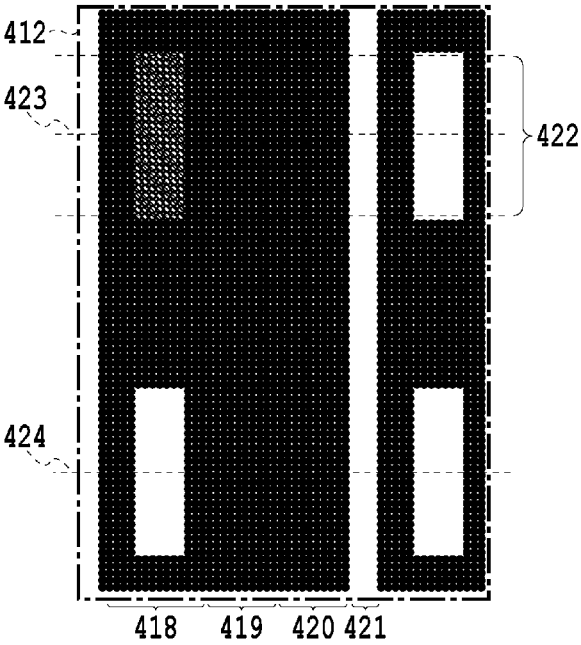
Figure 4D:
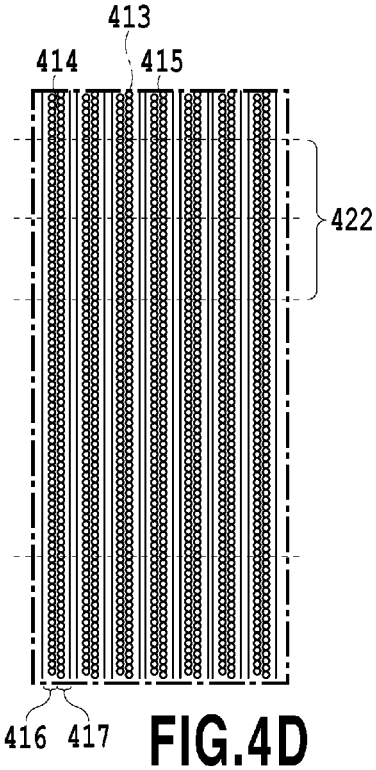

The test pattern 412 shown in FIG. 4C is an enlargement of a portion of the test pattern 402 show in FIG. 4B. The print head unit 413 shown in FIG. 4D is an enlargement of a portion of the print heads of the print head unit 400 shown in FIG. 4A. The print head 414 is a K (black) print head. The print head 415 is a Y (yellow) print head. Each print head is provided with 2 ejection port arrays as denoted by the ejection port array 416 and the ejection port array 417. In the figure each ejection port comprising each ejection port array is shown with a circular shape. The test pattern 412 illustrates an example printed by ink ejection from the ejection ports of the print heads shown at the print head unit 413. The method of printing the K (black) test pattern of the test pattern 412 will be explained. Each of the pattern regions 418 to 421 are pattern regions comprising the test pattern and are printed by the print head 414.

The pattern region 418 is a pattern region for recognizing, via the head position reference detection mark 411 and the detection mark 410, the relative positional relationship between the ejection ports on the print head and each of the pixels that form the test pattern. When printing the pattern region 418, in the case where there is an ejection port having an unsatisfactory printing state when printing the detection mark, in order to reduce the influence of the ink ejected from that ejection port, ejection ports of both the ejection port array 416 and the ejection port array 417 are used. Because, when printing the pattern region 418 the pattern is printed using multiple ejection ports arrays, even in the case where it is supposed that there are ejection ports having an unsatisfactory ejection state, ink drops are projected via ink ejection from the ejection ports of the other ejection port array. Thus, even if there are ejection ports having an unsatisfactory ejection status, it is possible to limit the occurrence of white stripes caused by printing not being performed from those ejection ports at a fixed location. Because the pattern region 418 is a pattern region for determining the relative positional relationship between the ejection ports of the print head and the test pattern, it is preferable that no white stripes appear within this pattern region. Due to this, because the relative positional relationship between the ejection ports on the print head and the test pattern are determined via the more clearly printed test pattern, positional accuracy between the print head and the test pattern is highly maintained.

In this embodiment, the head position reference detection mark 411 is printed solidly by the Y (yellow) print head ejection ports in the region corresponding to the void region 422 formed by K (black) ejection ports. The ejection port position that corresponds to the head position reference position detection mark 411 is defined as the ejection port position corresponding to the center position 423 of the head position reference detection mark 411. The detection mark 410 is printed by way of a void in the K (black) ink, and the ejection port position that corresponds to the reference for the detection mark 410 is defined as the ejection port position corresponding to the center position 424. Because the detection mark is formed with a rectangular void ink, ink is impacted onto the region adjacent to the later described pattern region 419 that detects ejection ports having an unsatisfactory ejection state. Due to this, when reading the test pattern, it is possible to reduce the occurrence of print image flare, and thereby it is possible to reduce the occurrence of undetectable portions of the pattern 419 caused by the influence of the base color of the print medium. The method of detecting the head position reference detection mark will be explained in detail at FIG. 12.

The pattern regions 419 and 420, in the case where there are ejection ports having an unsatisfactory ejection state on the print head, are pattern regions for detection those ejection ports. The pattern region 419 is a pattern region for the detection of ejection ports of the ejection port array 416 that have an unsatisfactory ejection state, and is printed solidly by the ejection port array 416. The pattern region 420 is a pattern region for the detection of ejection ports of the ejection port array 417 that have an unsatisfactory ejection state, and is printed solidly by the ejection port array 417. The pattern region 421 is a region at the tail end of the test pattern, and is a blank space between the next test pattern. Because there is a blank space established at this portion, the projection of ink at the pattern region 420 from print heads other than the detection target can be suppressed. Due to this, even in the case where there is a mounting position error of the print head that forms the test pattern on the upstream side of the conveyance direction of the print medium, or the case where there is a timing error in the ejection of ink, it is possible to reliably perform detection of the ink ejection status.

Figure 5:
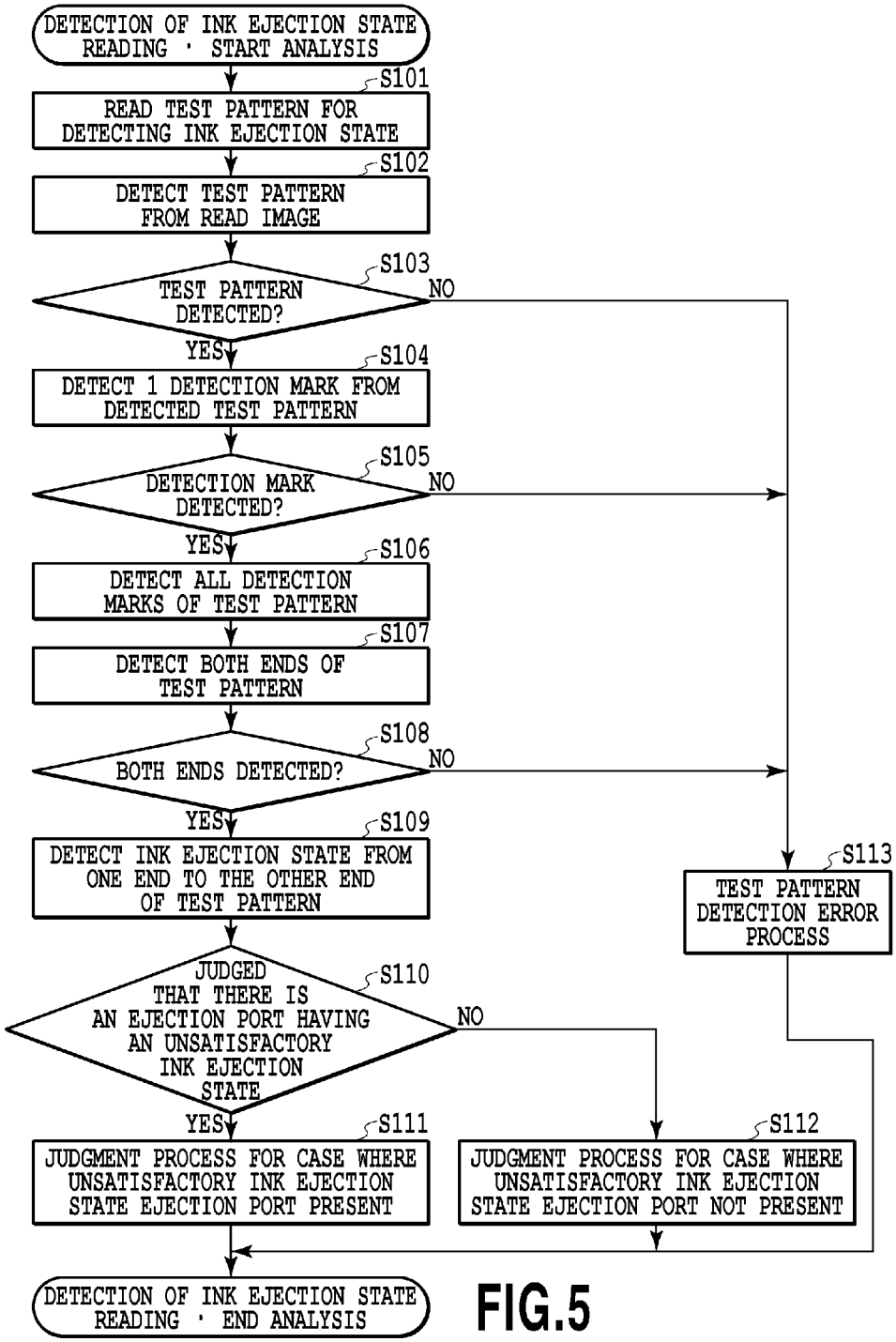
FIG. 5 is a flowchart illustrating the control flow when the detection of ink ejection state is performed with respect to the ejection ports of the print head, by the inkjet printing apparatus of FIG. 1.

FIG. 5 is a flowchart that relates to this embodiment and is for explaining the protocol of the reading and analyzing process of the test pattern for the detection process relating to ejection ports having an unsatisfactory ejection state. At step S101 the test pattern printed on the print medium is read by the scanner unit. As for the timing of the scan unit starting to read the test pattern, reading may be started after waiting a prescribed amount of time after commencing printing of the pattern. Or reading may be commenced after the print medium has been conveyed a prescribed amount after the printing of the pattern has been completed. As for the timing concerning reading termination, reading of the test pattern of this embodiment is terminated after the reading of a prescribed number of sub-scan lines have has been performed, after commencing reading.

At step S102 the scanner control unit detects the test pattern from the image read at step S101. It is determined whether a test pattern was printed in the read image. The details pertaining to the test pattern detection process will be described in detail at the explanation of the later described in FIG. 7. At step S103 the scanner control unit determines, from the image read at the process of step S102, whether a test pattern has been detected, and in the case where a test pattern has not been detected, executes a test pattern detection error process.

At step S104 the scanner control unit detects 1 detection mark from the test pattern of the read image, based on the detection position of the mask pattern detected at the step S102. The details pertaining to the detection mark detection process will be described in detail at the explanation of the later described FIG. 7. At step S105 the scanner control unit determines whether 1 detection mark was detected at the process of step S104, and in the case where it was not, executes a test pattern detection error process. At step S106, the scanner control unit detects all of the detection marks in the test pattern, based on the position detected at the process of step S104. The details pertaining to the detection process of all of the detection marks will be described in detail at the explanation of the later described FIG. 8.

At step S107 the scanner control unit detects both ends (in the head main scanning direction) of the test pattern. The detail pertaining to the detection process concerning both ends of the test pattern will be described in detail at the explanations of the later described FIGS. 8A to 8F and FIGS. 9A to 9F. At step S108 the scanner control unit determines whether a pattern end was detected at step S107, and in the case where one was not, executes a test pattern detection error process. At step S109 the scanner control unit analyzes the test pattern and detects areas where there are ejection ports having an unsatisfactory ejection state. The detection concerning ejection ports having an unsatisfactory ejection state is performed by carrying out a test pattern analysis from one end to the other end of each test pattern. The details pertaining to the process of analyzing ejection ports having an unsatisfactory ejection state will be described in detail at the explanation of the later described FIGS. 10A to 10C. At step S110 the scanner control unit confirms whether a region of ejection ports having an unsatisfactory ejection state was detected at step S109 at the region between both ends of the test pattern. For the case where there was a region of ejection ports having an unsatisfactory ejection state, a process is performed wherein it is judged that there are ejection ports having an unsatisfactory ejection state. For the case where there were not ejection ports having an unsatisfactory ejection state, a process is performed wherein it is judged that there are not ejection ports having an unsatisfactory ejection state.

At step S111 the scanner control unit, from the result analyzed from the test pattern, performs a process for the case where there is a judgment that there are ejection ports having an unsatisfactory ejection state. Here, the print control unit is notified that there are ejection ports having an unsatisfactory printing state, the printing operation is stopped, and the later described supplementation process is executed with respect to the ejection ports having an unsatisfactory ejection state. Note that in the case where it has been judged that there are ejection ports having an unsatisfactory ejection state, a print head unit recovery operation may be performed. At step S112, the scanner control unit, from the result analyzed from the test pattern, performs a process for the case where there a judgment that there are no ejection ports having an unsatisfactory ejection state. Here, the print control unit is notified that there are no ejection ports having an unsatisfactory printing state, and the printing operation is continued. At step S113 the scanning control unit, from the image read from the result analyzed from the test pattern, performs a process for the case where a test pattern can not be detected or for the case where a was a failure in detecting the detection mark. Here, the print control unit is notified that an error has occurred when printing the test pattern, and the printing operation is stopped.

Figure 6:
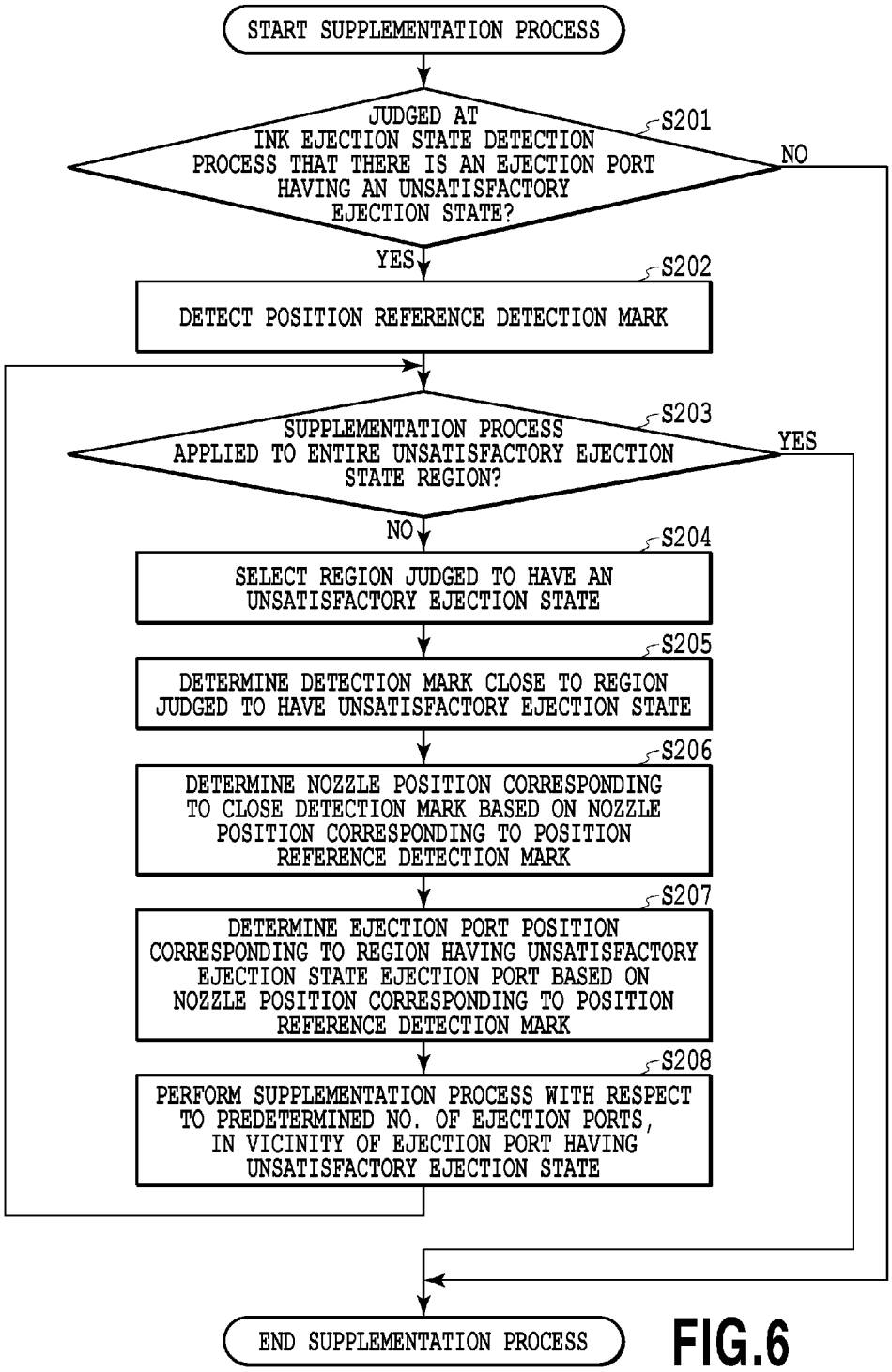
FIG. 6 is a flowchart illustrating the control flow when a supplementation process is performed with respect to ejection ports that have been detected as having an unsatisfactory ejection port state during the flow at FIG. 5.

FIG. 6 is a flowchart that relates to this embodiment and is for explaining the protocol of the supplementation process relating to ejection ports having an unsatisfactory ejection state. At step S201 the scanner unit, from the result of the detection process concerning the presence or absence of ejection ports having an unsatisfactory ejection state, it is determined whether there was a judgment that there are ejection ports having an unsatisfactory ejection state or there was a judgment that there are not ejection ports having an unsatisfactory ejection state. In the case where ejection ports having an unsatisfactory ejection state exist, a supplementation process is performed with respect to those ejection ports. In the case where ejection ports having an unsatisfactory ejection state do not exist the supplementation process is not performed.

At step S202, the scanner control unit detects the head position reference detection mark from the multiple detection marks. The process that detects the head position reference detection mark will be explained in detail at the later described FIGS. 12A to 12C. At step S203 the scanner unit selects the entire region where, at the detection process concerning the presence or absence of ejection ports having an unsatisfactory ejection state, it was judged that there are ejection ports having an unsatisfactory ejection state. Next, at the selected region it is judged whether a supplementation process has been carried out with respect to the ejection ports having an unsatisfactory ejection state. In the case where the supplementation process has been performed with respect to all of the ejection ports having an unsatisfactory ejection state, the process is terminated. At step S204 the scanner control unit selects, among the regions at which it was judged at the inspection process concerning the presence or absence of ejection ports having an unsatisfactory ejection state that there are ejection ports having an unsatisfactory ejection state, an area at which a supplementation process has not been performed with respect to the ejection ports having an unsatisfactory ejection state. At step S205 the scanner control detects the detection mark adjacent to the area of selected area of ejection ports having an unsatisfactory ejection state.

At step S206 the scanner unit, based on the position of the head position reference detection mark, determines the ejection port position on the print head corresponding to the adjacent detection mark. At step S207 the scanner unit, based on the ejection port position corresponding to the adjacent detection mark, detects the position of the ejection ports having an unsatisfactory ejection state. At step 208 a supplementation process is performed with respect to area of a predetermined number of ejection ports, including the ejection ports having an unsatisfactory ejection state.

The process of supplementing the ejection ports having an unsatisfactory ejection state at steps S205, S206, S207 and S208 will be described in detail at the later described explanation of FIG. 13.

FIGS. 7A to 7D are views for explaining, at the detection process of this embodiment concerning the presence or absence of ejection ports having an unsatisfactory ejection state, the process that detects the test pattern from the read image and the process that detects 1 detection mark from the detected test pattern.

The read image 700 shows an image of the test pattern printed on the print medium and read by the scanner unit. The read image 700 is a 16-bit RGB channel color image. The print medium exterior region 702 is the image region where areas outside of the print medium are read, and is the result from having read a member facing the reading position of the scanner. In this embodiment a calibration roller used in the calibration of the scanner is disposed at a location facing the sensor. A region facing the reading position of the scanner in the calibration roller is formed by a black member. Thus, when reading a print image with the scanner, the print medium exterior region 702 at which the calibration roller is positioned is an area at which the brightness is low in comparison to the base color of the print medium.

The calibration roller is a roller acquiring a white standard for the scanner; one portion of the roller surface region is the white standard region, and the region outside of that is the roller member. In this embodiment the roller member is formed from a black resin, and when this portion is read, along with the print image, by the scanner, the brightness value of this portion is low in comparison to the base color of the print medium. The roller member outside of the white standard region of the calibration roller may be a substance other than a black resin, and the entire surface of the roller may be the white standard region. In the case where the entire surface of the roller is made the white standard region, it is preferable to use a print medium in which the portion of the print surface outside of the printed image (the base color region) is close to black.

The test pattern detection region 703 shown in FIG. 7B is the investigation region at the process that detects the test pattern 701 from the read image 700 shown in FIG. 7A.

The process that detects the test pattern 701 will be explained next. The test pattern region 704 is an enlargement of a portion of the test pattern detection region 703. The test pattern detection judgment is performed by an average density threshold determination at a prescribed region. The judgment regions 705 to 708 are regions that respectively detect base color, K (black), M (magenta) and C (cyan) regions. The size of each region is a prescribed size smaller than the size of each test pattern, and the distance between each region corresponds to the distance between each test pattern.

The judgment region 705 is a region at which a judgment is performed for the base color region. As for the judgment method for the base color region, when the average brightness of the R channel inside the region is above a predetermined threshold, the average brightness of the G channel is above a predetermined threshold, and the average brightness of the B channel is above a predetermined threshold, it is judged that the detected area is a base color region.

The judgment region 706 is a region at which a judgment is performed for the K (black) region. As for the judgment method for the K (black) region, when the average brightness of the R channel inside the region is below a predetermined threshold, the average brightness of the G channel is below a predetermined threshold, and the average brightness of the B channel is below a predetermined threshold, it is judged that the detected area is a K region.

The judgment region 707 is a region at which a judgment is performed for the M (magenta) region. As for the judgment method for the M (magenta) region, when the average brightness of the R channel inside the region is higher than a predetermined threshold, the average brightness of the G channel is below a predetermined threshold, and the average brightness of the B channel is higher than a predetermined threshold, it is judged that the detected area is a M region.

The judgment region 708 is a region at which a judgment is performed for the C (cyan) region. As for the judgment method for the C (cyan) region, when the average brightness of the R channel inside the region is below a predetermined threshold, the average brightness of the G channel is higher than a predetermined threshold, and the average brightness of the B channel is higher than a predetermined threshold, it is judged that the detected area is a C region.

In the case where it is determined that each of the judgment regions 705 to 708 are respectively base color, K, M and C regions it is judged that the test pattern has been detected. On the other hand, in the case where it is determined that one or more of the judgment regions 705 to 708 is not respectively a base color, K, M, or C region, it is judged that the test pattern has not been detected.

The process that detects 1 detection mark from the test pattern will be explained next. Detection of the detection mark is performed by an image cross-correlation process with a prescribed region based on the detected position of the test pattern taken as the investigation region image of the detection mark and a detection mark image held in advance being taken as the template region. In this embodiment, a SSD (sum of squared intensity difference) is used as the image cross-correlation process, and a method in which the difference between the investigation region and the template image is detected by calculation, is used. Note that other calculation methods such as SAD (sum of absolute difference) or NCC (normalized cross-correlation), etc., may also be used as the image cross-correlation process. In FIGS. 7A to 7D and FIGS. 8A to 8F, a cross mark has been applied to detection targets or detection marks at which detection processing has been completed, as a matter of convenience.

The image cross-correlation process is performed using the information of 1 channel among the RGB channels of the read image. The channel used at the process may be channel at which color brightness at read image of each test pattern is the lowest. For example, in the case of Cyan, because in the read image the brightness of the R channel is the lowest, the R channel may be processed.

Based on the above mentioned detected position of the test pattern, the investigation area 709, shown in FIG. 7C, for detecting the detection mark is a region at which it can be guaranteed that a detection mark is included, and is the investigation region image detected by the SSD. The template image for the detection mark 710, shown in FIG. 7D, is a detection mark image held in advance, and is the template image used in SSD. The arrows 712, illustrate the direction in which the process at which the scanner unit is scanned on the template image and the SSD is calculated is performed, at the image cross-correlation process between the detection mark investigation area 709 and the detection mark template region 710. As a result of the SSD, at the position where the difference is the smallest, it is determined that the detection mark of the detection target is at the detection mark position if that difference is below a prescribed value, and it is determined that the detection mark of the detection target is not at the detection mark position in the case where the difference is larger than the prescribed value. In this manner the template image setup in advance and the read test pattern image are compared, and a determination of the relative positional relationship between the print head and the test pattern is performed.

FIGS. 8A to 8F are views for explaining, at the detection process of this embodiment concerning the presence or absence of ejection ports having an unsatisfactory ejection state, the process that detects all of the detection marks in the test pattern printed during a marginless printing and the process that detects both ends of the test pattern.

Figure 8A:
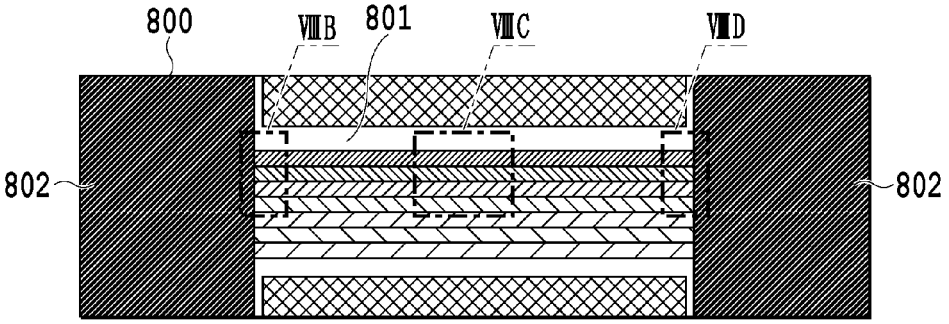
FIGS. 8A to 8F are plan views for explaining the detection process concerning the position of both ends of the test pattern of FIGS. 7A to 7D and the detection mark detection process.
Figure 8B:
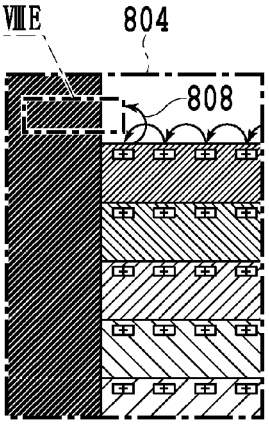
Figure 8C:
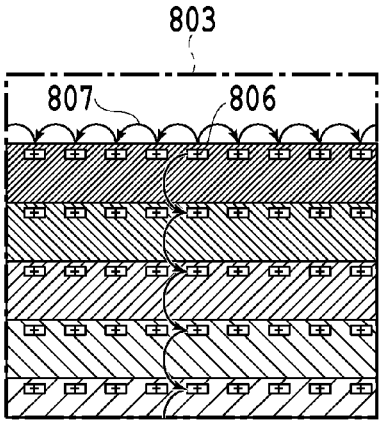
Figure 8D:
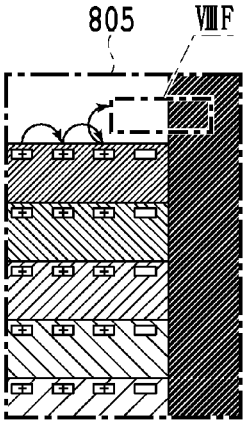

The read image 800 shown in FIG. 8A shows an image read from the test pattern region by the scanner unit. The read image 800 is a 16-bit RGB channel color image. The print medium exterior region 802 shown in FIGS. 8B, 8C are the image regions where areas outside of the print medium are read, and are the result from having read a member facing the reading position of the scanner. In this embodiment the member facing the sensor is a calibration roller used in the calibration of the scanner. When reading, because the region of the calibration roller facing the reading position is a region of a black member, the print medium exterior region 802 is a region with a low brightness. The test pattern region 803 shown in FIG. 8C is an enlargement of a region surrounding the detection marks. The test pattern region 804 shown in FIG. 8B is an enlargement of the left end region of the test pattern. The test pattern region 805 shown in FIG. 8D is an enlargement of the right end region of the test pattern. The detection mark detection position 806 denotes the detected detection mark position at the prior described process that detects 1 detection mark.

The process that detects all detection marks will be explained next. The arrows 807 denote a direction in which the process that detects consecutive detection marks based on the positions of adjacent voided detection marks at which detection has been completed is performed. The process that detects the detection marks is performed by an image-cross correlation process, based on the positions of detection marks at which detection has been completed, with a prescribed region at the detection mark position of the detection target taken as the investigation region image of the detection mark and a detection mark image held in advance being taken as the template region. The particulars of the image correlation process are the same as that of the process that detects 1 detection mark, explained above explanation with FIGS. 7A to 7D. As a result of the SSD, at the position where the difference is the smallest, it is determined that the detection mark of the detection target is at the detection mark position if that difference is below a prescribed value, and it is determined that the detection mark of the detection target is not at the detection mark position in the case where the difference is larger than the prescribed value. As for the detection of detection marks, in this embodiment the detection process is repeated from the detection mark detection position 806 along the leftward direction of the test pattern shown in FIGS. 8B, 8C. As a result of the SSD, in the case where it has been determined that the difference is larger than a prescribed value and that the detection mark is not at the detection mark position, the sequentially performed detection mark detection process is terminated. Next, sequential detection mark detection processing is repeated from the detection mark detection position 806 along the rightward direction of the test pattern shown in FIGS. 8C, 8D. As a result of the SSD, in the case where it has been determined that the difference is larger than a prescribed value and that the detection mark is not at the detection mark position, the sequentially performed detection mark detection process is terminated. Next, detection of the test pattern detection mark below the detection mark detection position 806 is performed, and in similar fashion leftward detection mark detection and rightward detection mark detection is repeated.

Figure 8E:
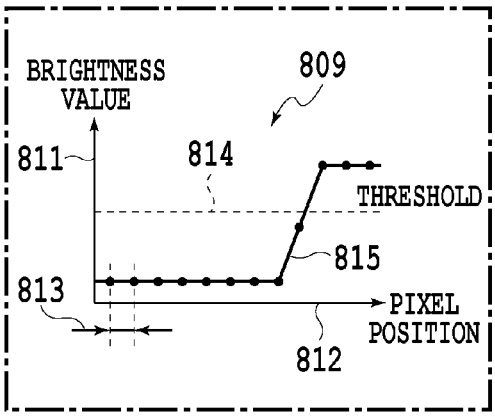
Figure 8F:
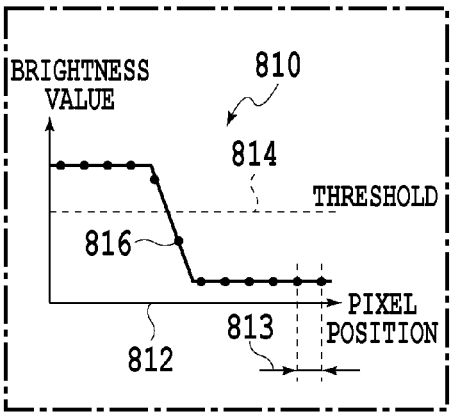

The process that detects both ends of the pattern will be explained next. Detection of both ends of the pattern, in the later described process of analyzing ejection ports having an unsatisfactory ejection state, is performed in order to define the analyzing range when performing an analysis of the printed test pattern. First, the case where the inkjet printing apparatus is set to a marginless printing mode in which printing is performed without a margin will be explained. As for detection of both ends of the pattern, because printing of the test pattern is carried out by marginless printing on the print medium, the ends of the print medium may be detected. Detection of the left end of the pattern will be explained next. The arrow 808 in the test pattern 804 denotes the process that determines the detection region of the left end of the pattern from the position of the detected left end detection mark. The detection region of the left end of the pattern is a region that includes the print medium exterior region 802 and a base color region of the print medium. The graph 809 shown in FIG. 8E is a graph that shows average brightness values, with brightness values of the detection area of the left end of the pattern averaged in the conveyance direction of the print medium. The vertical axis 811 indicates brightness and the horizontal axis 812 indicates average pixel location. The average pixel space 813 corresponds to an interval of 1 pixel read by the scanner. The brightness threshold 814 is a threshold used when judging the end of the pattern. The end of the pattern is judged to be the average pixel location in the vicinity where the average brightness and the threshold value intersect. At the graph 809 the pattern end pixel location 815 is detected as the left end of the pattern.

Detection of the right end of the pattern is carried out in the same way as that of the left end of the pattern. At the graph 810 shown in FIG. 8F, the pattern end pixel location 816 is detected as the right end of the pattern.

As stated above, the inkjet printing apparatus 200 has a marginless test pattern end detection means that detects the location of both ends of a marginless test pattern printed by the ejection of ink from ejection ports used when performing printing in a marginless printing mode. In this embodiment the CPU 201 functions as the marginless test pattern end detection means. In this embodiment brightness values are detected at each location of the region at which the marginless test pattern is formed, along the alignment direction of the nozzle arrays. The portion of the detected brightness values that are lower than the brightness threshold set in advance is recognized as the region outside of the marginless test pattern. Accordingly, the position of the region outside of the marginless test pattern is designated, and the position of an end of the marginless test pattern is detected.

Next, the case where the inkjet printing apparatus is set to a margined printing mode in which printing is performed with a margin will be explained. FIGS. 9A to 9F are views for explaining, at the judgment process of this embodiment concerning the presence or absence of ejection ports having an unsatisfactory ejection state, the process of detecting the end of the test pattern printed with a margin. At FIGS. 8A to 8F, the process for a test pattern printed without a margin was explained, however, here a process for a test pattern printed with a margin will be explained, in the case where the print medium width is larger than the width print range.

Figure 9A:
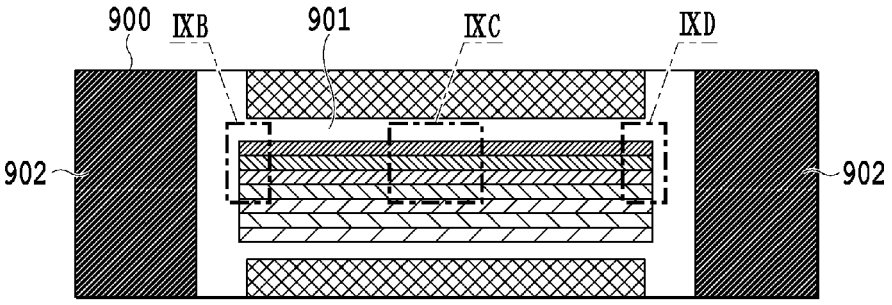
FIGS. 9A to 9F are views for explaining the detection process concerning the position of both ends of the test pattern used at the margined printing caused by the inkjet printing apparatus of FIG. 1, and the detection mark detection process.

An image 900 shown in FIG. 9A is read image of the test pattern region read by the scanner unit. The read image 900 is a 16-bit RGB channel color image. The print medium exterior region 902 is the image region where areas outside of the print medium are read. In this embodiment the calibration roller is disposed at a position facing the sensor. When reading a print image with the scanner, the print medium is disposed above the calibration roller and the difference in brightness between the base color portion of the print medium and the calibration roller is clear. When reading a print image with the scanner the print medium exterior region 902 is an area at which the brightness is low in comparison to the base color of the print medium, because the calibration roller region facing the reading position is formed by a black member.

Figure 9B:
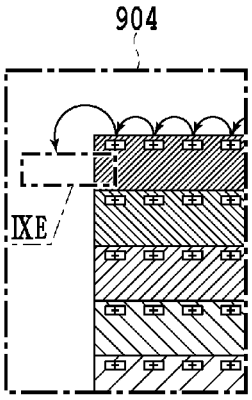
Figure 9C:
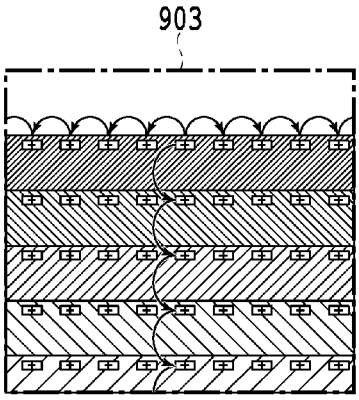

The test pattern region 903 shown in FIG. 9C is an enlargement of a region surrounding the detection marks. The test pattern region 904 shown in FIG. 9B is an enlargement of the left end region of the test pattern. The test pattern region 905 shown in FIG. 9D is an enlargement of the right end region of the test pattern.

Detection of detection marks can be performed by the same method described at FIGS. 8A to 8F.

Figure 9D:
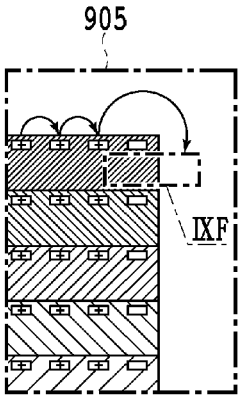

Note that, in this embodiment, the voided detection mark formed at the rightmost side of the test pattern shown in FIG. 9D is not used in a confirmation of the relative positional relationship between the print head and the test pattern. This is because reliability when confirming the positional relationship is low at the end vicinity of the test pattern, because at the time of comparing the template image and the read test pattern image, noise from the print medium base color portion outside the test pattern is included in the read test pattern image. Also, it is more accurate to directly use the end position of the test pattern because the end of the test pattern is more accurately detected by way of the brightness difference between the test pattern portion and the base color portion. Thus a voided detection mark formed at a position close to the end of the test pattern may not be used when confirming the relative positional relationship between the print head and the test pattern.

The process that detects both ends of the pattern will be explained next. Detection of both ends of the pattern is an analyzing process concerning ejection ports having an unsatisfactory ejection state, as described later, and is a process that detects both ends (in the width direction of the print medium) of the pattern in order to analyze the entire region of the printed test pattern. Here, because a margined printing of the test pattern on the print medium occurs at the detection of both ends of the pattern, and end of the test pattern may be detected.

Figure 9E:
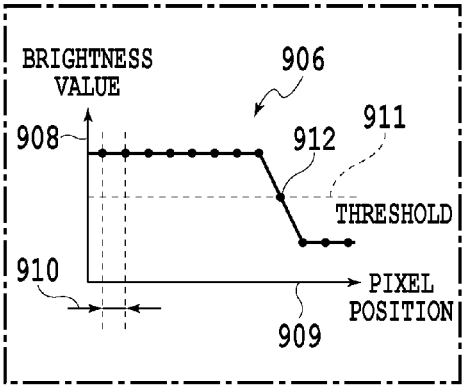
Figure 9F:
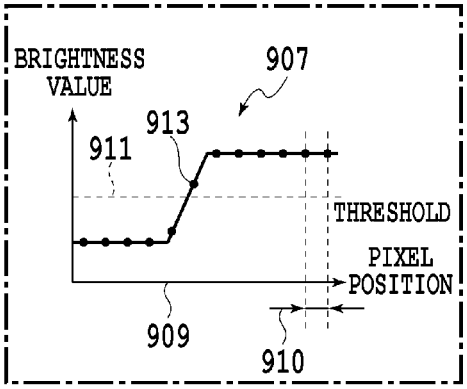

As one example of test pattern detection, detection at the left end of the test pattern of the figure will be explained. The graph 906 shown in FIG. 9E is a graph that shows, based on the detected left end detection mark position of the left end of the pattern, average brightness values, with brightness values of the end region of the pattern averaged in the conveyance direction of the print medium. The vertical axis 908 indicates brightness and the horizontal axis 909 indicates average pixel location. The average pixel space 910 corresponds to the interval between pixels when the scanner is reading, and it is one interval length. The brightness threshold 911 is a threshold for judging the end of the pattern. The end of the pattern is judged to be the average pixel location in the vicinity where the average brightness and the threshold value intersect. At the graph 906 the pattern end pixel location 912 is detected as the left end of the pattern.

Detection of the right end of the pattern is carried out in the same way as the detection of the left end of the pattern. At the graph 907 shown in FIG. 9F, the pattern end pixel location 913 is detected as the right end of the pattern.

As stated above, the inkjet printing apparatus 200 has a margined test pattern end detection means that detects the location of both ends of a margined test pattern printed by the ejection of ink from ejection ports used when performing printing in a margined printing mode. In this embodiment the CPU 201 functions as the margined test pattern end detection means. In this embodiment, brightness values are detected at each location of the region at which the margined test pattern is formed, along the alignment direction of the nozzle arrays. The portion of the detected brightness values that are exceed the brightness threshold set in advance is recognized as the region outside of the margined test pattern. Accordingly, the position of the region outside of the margined test pattern is designated, and the position of an end of the margined test pattern is detected.

Figure 10B:
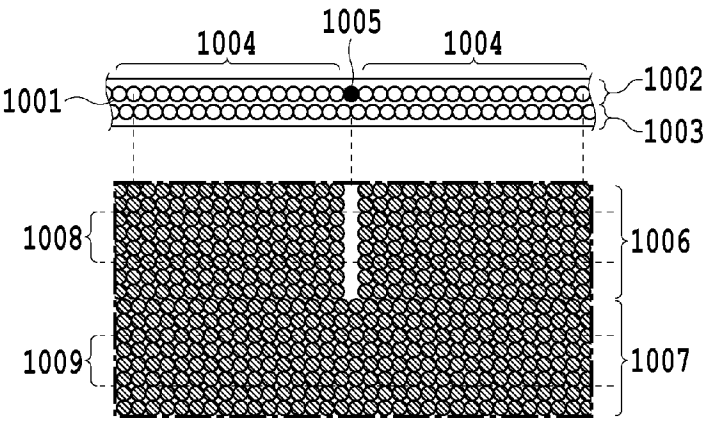
FIGS. 10A to 10C are views for explaining the detection process when detecting, from the test pattern of FIGS. 8, 9, ejection ports having an unsatisfactory ejection state.
Figure 10C:
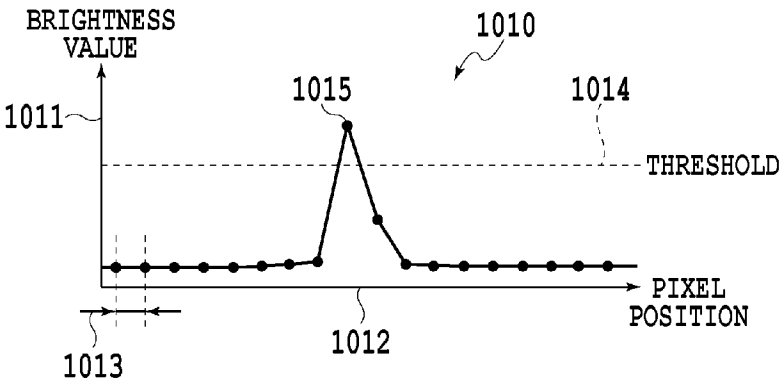
Figure 10A:
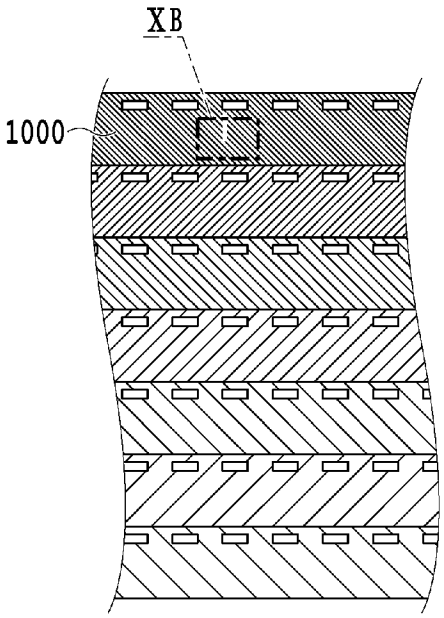

FIGS. 10A to 10C are graphs for explaining, at the detection process of this embodiment concerning the presence or absence of ejection ports having an unsatisfactory ejection state, in the case where ejection ports having an unsatisfactory ejection state exist, the process of detecting those ejection ports. The test pattern 1000 shown in FIG. 10A is a K (black) print head test pattern. The print head 1001 is an enlargement of a portion of the K (black) print head. The print head 1001 comprises 2 ejection port arrays; ejection port array 1002 and ejection port array 1003. The ejection ports 1004 are ejection ports that eject ink normally. The ejection port 1005 is an ejection port with an unsatisfactory ejection state. The detection region 1006 is a pattern region that detects ejection ports having an unsatisfactory ejection state at the ejection port array 1002.

As shown in the figure, a white line is generated in the printed pattern because of the ejection port 1005 that is in the ejection port array 1002 and has an unsatisfactory ejection state. The detection region 1007 is a pattern region that detects ejection ports having an unsatisfactory ejection state at the ejection port array 1003.

The process of analyzing ejection ports having an unsatisfactory ejection state will be explained next.

As for the inkjet printing apparatus 200, a detection of the ink ejection status is performed, from a region of the test pattern printed between two ends that are detected in advance, with respect to ejection ports that eject ink that forms the pixels of the test pattern. In the case where a marginless printing mode has been set, a detection of the ink ejection status is performed with respect to ejection ports that perform printing at a region between both ends, detected in advance, of a marginless test pattern, and that eject ink that forms the pixels of the marginless test pattern. As described above the inkjet printing apparatus 200 has a marginless printing ejection state detection means that performs, from a marginless test pattern, the detection of the ink ejection state. In this embodiment the CPU 201 functions as the marginless printing ejection state detection means that performs, from a marginless test pattern, the detection of the ink ejection state. On the other hand, in the case where a margined printing mode has been set, a detection of the ink ejection status is performed with respect to ejection ports that perform printing at a region between both ends, detected in advance, of a margined test pattern, and that eject ink that forms the pixels of the margined test pattern. As described above the inkjet printing apparatus 200 has a margined printing ejection state detection means that performs, from a margined test pattern, the detection of the ink ejection state. In this embodiment the CPU 201 functions as the margined printing ejection state detection means that performs, from a margined test pattern, the detection of the ink ejection state.

When detection of the ink ejection state is being performed, the analyzing process is performed by analyzing the presence or absence of ejection ports having an unsatisfactory ejection state, from the image read from the test pattern. In this embodiment, based on the brightness value of the test pattern inside the detection region, the presence or absence of ejection ports having an unsatisfactory ejection state is analyzed. The inkjet printing apparatus 200 is configured such the reading resolution of the scanner is lower than the alignment resolution of the ejection ports of the print head. Because of this, at the judgment with respect to the presence or absence of ejection ports having an unsatisfactory ejection state, an ejection port region that includes multiple ejection ports, not one ejection port, is designated, and the judgment concerning the presence or absence of ejection ports having an unsatisfactory ejection state is performed with respect to that multiple ejection port unit region. Note that this embodiment is a configuration in which the alignment resolution of the ejection ports of the print head is lower than the reading resolution of the scanner, but a configuration in which the alignment resolution of the ejection ports is higher than the reading resolution of the scanner may also be used. In the analyzing process concerning ejection ports having an unsatisfactory ejection state, described later, units comprising 1 ejection port may be designated.

The analysis concerning ejection ports having an unsatisfactory ejection state is performed using the information of 1 channel among the RGB channels of the read image. The analyzed channel may be the channel at which the print head color brightness at the read image of each test pattern is the lowest. For example, in the case of Cyan, because in the read image the brightness of the R channel is the lowest, the R channel may be analyzed.

The graph 1010, shown in the FIG. 10C, shows brightness values of the read image, at the detection region 1006 at which detection concerning ejection ports having an unsatisfactory ejection state has been performed based on detected position of the detection mark, with the brightness values averaged in the conveyance direction of the print medium. The vertical axis 1011 indicates brightness value and the horizontal axis 1012 indicates average pixel location. The average pixel space 1013 corresponds to the interval between pixels when the scanner is reading, and it is one interval length. The brightness threshold 1014 is a threshold for judging, based on the average brightness level, pixels caused by the ejection of ink from ejection ports having an unsatisfactory ejection state. At the graph 1010 it is determined that the pixel 1015 is a pixel caused by the ejection of ink from an ejection port having an unsatisfactory ejection state. In the detection process of this embodiment a region containing multiple ejection ports corresponding to pixels caused by ink ejected from ejection ports having an unsatisfactory ejection state is made the unsatisfactory ejection state ejection port region.

FIGS. 11A to 11D are diagrams for explaining 1 example of the arrangement of position reference detection marks on the test pattern. In FIGS. 11A to 11D, an example is shown in which, using roll paper as the print medium 1100, a test pattern 1106, which is for the detection process concerning the presence of ejection ports having an unsatisfactory printing state onto the print medium 1100, is printed. The print head unit 1101 is provided with multiple print heads. The print head unit 1101 is the same as the print head unit explained at FIGS. 3A to 3C.

The main scanning direction 1102 of the print head denotes the scanning direction when the print head unit 1101 performs a main scan. The details pertaining to the main scanning direction 1102 are the same as that of the movement of the print head main scanning explained at FIG. 3. The test pattern region 1108 is a region printed on the print medium and is the region that becomes the target of the analysis concerning the presence or absence of ejection ports having an unsatisfactory ejection state, when performing printing without a margin.

Figure 11B:
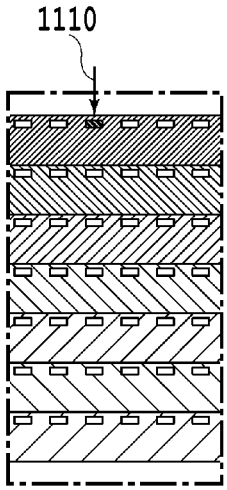
FIGS. 11A to 11D are plan views for explaining the position reference detection mark in the test pattern printed by the inkjet printing apparatus of FIG. 1.
Figure 11C:
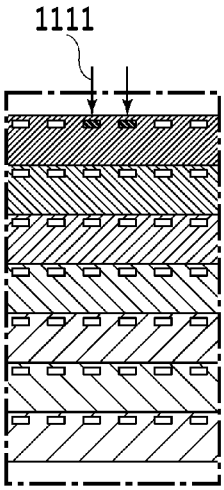
Figure 11D:
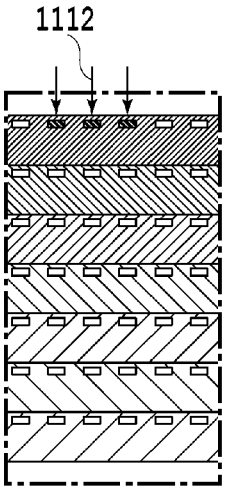
Figure 11A:
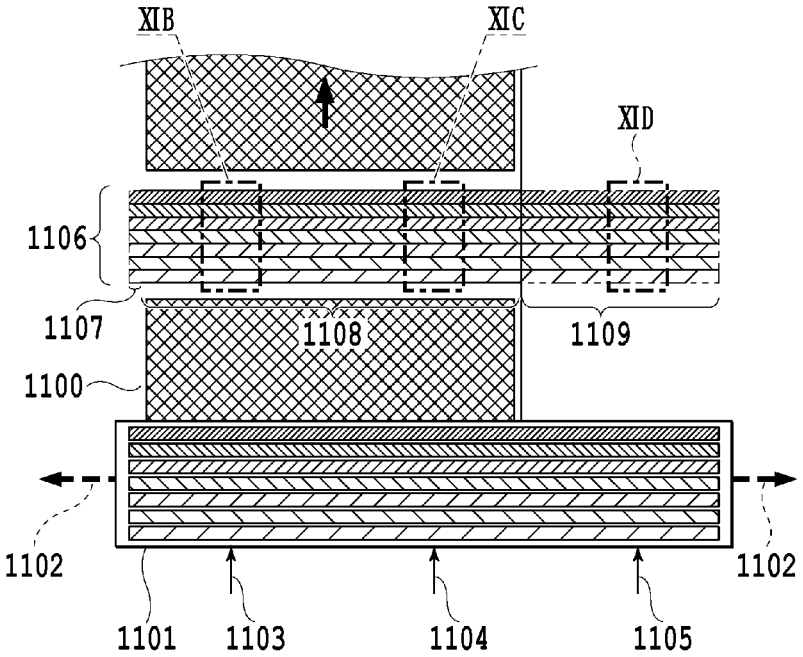

The test pattern regions 1107 and 1109 are test pattern regions outside of the print medium, and are regions at which printing is not performed on the print medium in the main scanning direction. As shown at FIG. 11A, one portion of the test pattern may be formed outside of the print medium. By way of this it is possible to more reliably confirm the relative positional relationship between the test pattern and the ejection ports that form the respective pixels of the test pattern.

The head position reference detection marks, for the print head, will be explained next. The head position reference detection marks are arranged on the test pattern such that at least one or more head position reference detection marks are printed within the test pattern on the print medium. Here, all combinations are possible concerning the width of the print medium in use and the locations to which the print head can move along the main scanning direction. In the present embodiment, as shown at FIGS. 11B to 11D, three head position reference detection marks 1110, 1111 and 1112 are arranged within the printable range corresponding to the width of the print head. The 3 head position reference detection marks are differentiated by the number of consecutive marks in the head main scanning direction. By differentiating each of the head position reference detection marks it is possible to specify the position of each head position reference detection mark, and it is possible to specify the ejection ports that form each of the head position reference detection marks.

The first head position reference detection mark 1110, shown in FIG. 11B, corresponds to the head position 1103. Because the first head position reference detection mark 1110 comprises only 1 mark, the center of the mark is the reference position.

The second head position reference detection mark 1111, shown in FIG. 11C, corresponds to the head position 1104. Because the second head position reference detection mark comprises 2 marks consecutively arranged in the head main scanning direction, the center of the left side mark is the reference position.

The third head position reference detection mark 1112, shown in FIG. 11D, corresponds to the head position 1105. Because the third head position reference detection mark comprises 3 marks consecutively arranged in the head main scanning direction, the center of the central mark is the reference position. The process of detecting the head position reference detection marks will be explained in detail at FIGS. 12A to 12C.

Figure 12A:
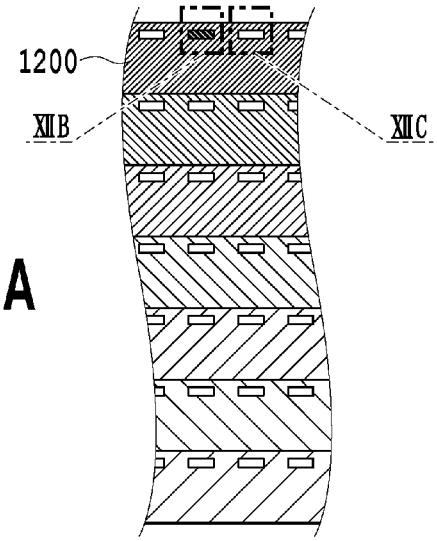
FIG. 12A to 12C are views for explaining the detection process when detecting the position reference detection mark in the test pattern printed by the inkjet printing apparatus of FIG. 1.
Figure 12B:
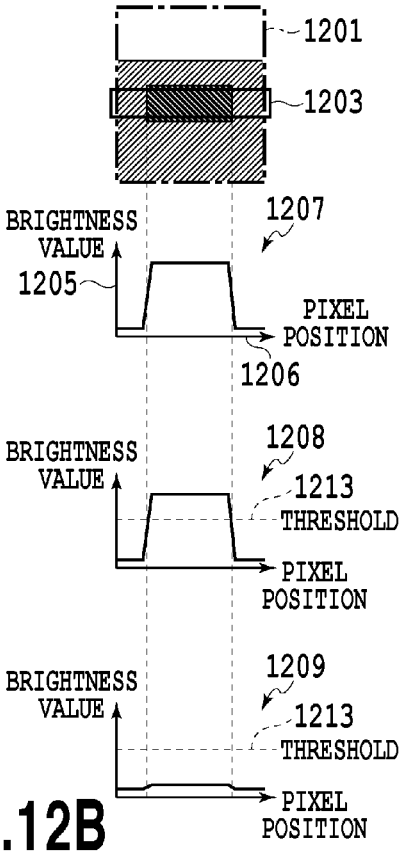
Figure 12C:
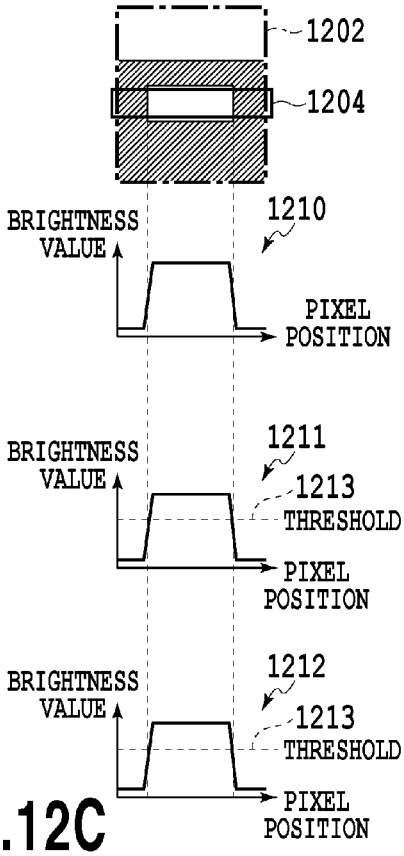

FIG. 12A to 12C are graphs for explaining, at the supplementation process of this embodiment concerning the ejection ports having an unsatisfactory ejection state, the process of detecting head position reference detection marks for the print head.

The test pattern 1200 is a K (black) print head test pattern. FIG. 12B is an enlarged view of the head position reference detection mark 1201 that is a head position reference detection mark of the test pattern 1200. FIG. 12C is an enlarged view of the detection mark position of the test pattern 1200.

The process that detects a head position reference detection mark will be explained next. The head position reference detection mark is detected based on the brightness value of each RGB channel of the voided region of the detected detection mark. Because the voided region of the detection mark is printed solidly with Y (yellow), judgment of whether a detected region is the head position reference detection mark is performed by determining whether the brightness value of the B channel of the solidly printed region is below a predetermined value. The average brightness region 1203 indicates the average brightness value of the head position reference detection mark region, along the direction in which the print medium is conveyed. The average brightness region 1204 indicates the average brightness value of the detection mark region, along the direction in which the print medium is conveyed.

The graphs 1207 to 1209 shown in FIG. 12B are figures that show brightness values at the average brightness region 1203; 1207 indicates the R channel, 1208 indicates the G channel, and 1209 indicates the brightness of the B channel. The graphs 1210 to 1212 are figures that show brightness values at the average brightness region 1204; 1210 indicates the R channel, 1211 indicates the G channel, and 1212 indicates the brightness of the B channel. At each graph the Y axis 1205 indicates brightness value and the X axis 1206 indicates average pixel location.

The threshold value 1213 is a brightness threshold value for judging whether the average brightness region is a base color region or a solidly printed Y (yellow) region. The head position reference detection mark is detected by there being a region of the graph 1208 where the average brightness value of the G channel is equal to or above the threshold value 1213, and there not being a region of the graph 1209 where the average brightness value of the B channel is equal to or above the threshold value 1213. The detection mark is detected by there being a region of the graph 1211 where the average brightness value of the G channel is equal to or above the threshold value 1213, and there being a region of the graph 1212 where the average brightness value of the B channel is equal to or above the threshold value 1213.

Figure 13:
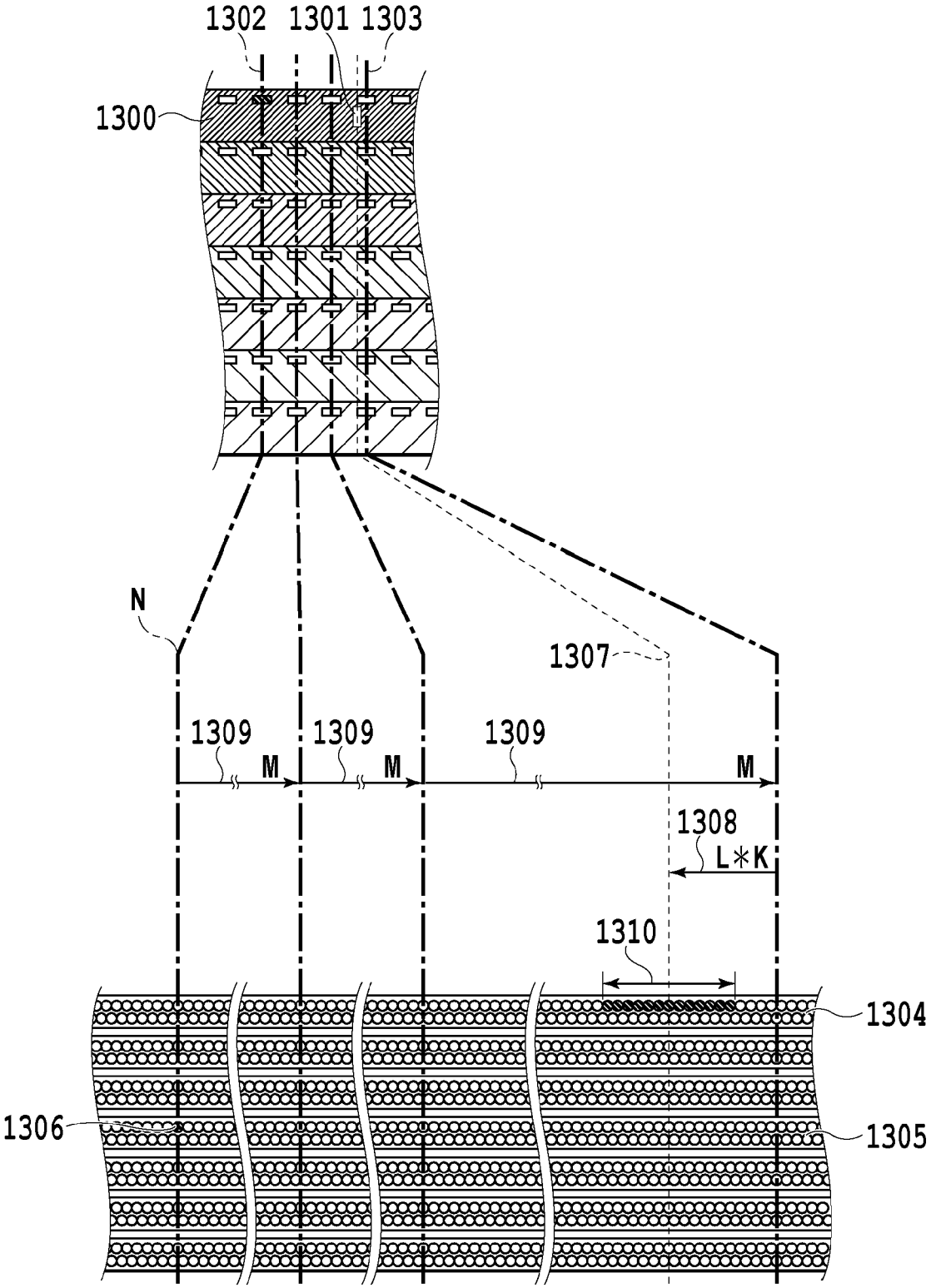
FIG. 13 is a view for explaining the detection process for detecting the position of ejection ports that have been detected as having an unsatisfactory ejection state by the test pattern printed by the inkjet printing apparatus of FIG. 1.

FIG. 13 is a graph for explaining, at the supplementation process of this embodiment concerning the ejection ports having an unsatisfactory ejection state, the supplementation process of the ejection ports of a predetermined range in the vicinity of the ejection ports having an unsatisfactory ejection state. Using FIG. 13 an example will be explained of the supplementation process at the printing region 1301 printed by the ejection ports having an unsatisfactory printing state, detected at the detection process concerning the presence or absence of ejection ports having an unsatisfactory ejections state. The test pattern 1300 is a K (black) print head test pattern.

First, at the supplementation process with respect to the ejection ports having an unsatisfactory ejection state, the head position reference detection mark 1302 is detected. Next, the detection marks that are close to the printing region 1301, printed by ejection ports in an unsatisfactory printing state, are detected. Here, based on the position of the printing region printed by ejection ports in an unsatisfactory printing state and the position of the detection marks for which detection has been completed, the detection mark 1303, which is closest to the printing region 1301 printed by ejection ports in an unsatisfactory printing state, is detected. Next, the ejection port position corresponding to the detection mark 1303, on the print head is specified. Because the detection mark 1303 is arranged at a position in which the length between the detection mark 1303 and the print head reference detection mark 1302 has 3 detection-mark-length intervals, taking N as the ejection port position of the head position reference detection mark and M as the distance between each of the detection marks, the ejection port position of the detection mark 1303 is $N+(M\times3)$. Next, the position within the print head of the ejection ports having an unsatisfactory ejection port state is specified. The distance between the printing region printed by ejection ports in an unsatisfactory state and its closest detection mark, in the read image, is taken as L pixels. When the distance between each of the pixels corresponds to K ejection ports, the position 1307 of the region of ejection ports having an unsatisfactory ejection state, on the print head, is taken as $N+(M\times3)+(L\times K)$. In this embodiment L is a negative value. Next a supplementation process is performed for a prescribed number of ejection ports in the vicinity of the designated ejection port region of ejection ports having an unsatisfactory ejection state. Because there is a possibility that an error can occur with respect to the position of designated ejection port during the supplementation process, the supplementation process is performed with respect to not only the designated ejection port, but with respect to a prescribed number of ejection ports. In this embodiment, the resolution of the analyzed image being lower than the alignment resolution of the ejection port array can be cited as one source of error. Because the resolution of the read image is low, it is not possible to specify in 1 ejection port units the position of detected ejection ports, at the detection process concerning the presence or absence of ejection ports having an unsatisfactory ejection state. Because of this a surrounding region of ejection ports containing the ejection ports having an unsatisfactory ejection state is detected. The possibility of the read image being warped in the main scanning direction of the print head, due to the influence of the aberration difference when the scanner reads, can be cited as another source of error. When the predetermined number of ejection ports subjected to the supplementation process is made 13, supplementation processing is performed with respect to the supplementation process target ejection ports 1310, from the ejection port obtained from calculating $N+(M\times3)+(L\times K)-6$ (ejection port position) to the ejection port obtained from calculating $N+(M\times3)+(L\times K)+6$ (ejection port position).

As described above, in the present embodiment a test pattern corresponding to a margined printing is printed when the image of a print job in which the setting of a margined printing has been performed is printed. And a test pattern corresponding to a marginless printing is printed when the image of a print job in which marginless printing has been set. When printing an image of a print job in which a marginless printing has been set, the ends of the test pattern are detected based on the difference in brightness between the base color portion of the print medium and the portion outside the print medium (the calibration roller). More concretely, because the brightness of the base color portion of the print medium is generally higher, the portion whose brightness is higher than the brightness threshold set in advance is detected as the end position of the test pattern region. When printing an image of a print job in which a margined printing has been set, the ends of the test pattern are detected based on the difference between the test pattern portion and the base color portion of the print medium. More concretely, because the brightness of the portion outside the test pattern on the print medium is generally higher, the portion whose brightness is higher than the brightness threshold value set in advance is determined to be a region outside of the test pattern, and the end position of the test pattern is detected. Thus with respect to the region between the ends of the detected test pattern, a detection is carried out with respect to the state of ink ejected from the ejection ports.

Thus, in both the case of performing the printing of an image of a print job at which a margined printing has been set and the case of performing the printing of an image of a print job at which a marginless printing has been set, a detection is performed with respect to the state of ink ejection from ejection ports, at the region between the ends of a test pattern corresponding to the print mode. Thus, with respect to ejection ports outside of the area used when printing, the useless performance, at unnecessary areas, of the detection of the state of ink ejected from ejection ports can be suppressed. It is also possible to suppress the performance of printing without the performance of a detection of the state of ink ejection from ejection ports, without regard to the ejection ports used in printing.

As described above, because it is possible to repress the useless performance of the detection of ink ejection state with respect to the ejection ports formed at a region where detection is not necessary, the time necessary for the detection process can be shortened. Thus it is possible to suppress lower the burden on the user when using the inkjet printing apparatus. Also, because detection of the state of ink ejection from the ejection ports is performed more reliably with respect to the ejection ports used when printing, it is possible to suppress lower the occurrence of ink ejection from ejection ports having an unsatisfactory ejection state. Because of this it is possible to maintain print image quality at a high level.

Note that while in the above embodiment the surface of print medium on which printing is performed was described as having a white color, the invention is not limited to such. The print medium may also be a non-white color as long as a brightness difference can be detected between it and the region outside of the print medium, and a brightness difference can be detected between it and the test pattern. The calibration roller may also be a color other than black as long as a brightness difference can be detected between it and the print medium.

It should be noted that in this specification "printing" is not used exclusively to indicate the formation of information containing meaning, such as characters, graphics, etc.; it is used without regard to whether the printed matter has meaning or does not have meaning. Furthermore, it also broadly expresses the formation of an image, figure or pattern, etc., on a print medium without regard to whether it is actualized as an object that can visually perceived by a human being, and broadly expresses the processing of a print medium.

"Ink jet printing apparatus" includes apparatuses, such as printers, all-in-one printers, copy machines and facsimile machines, which have a printing function, and also manufacturing equipment that produces goods while using ink jet printing technology.

Furthermore, the definition of "ink" (also referred to as "fluid") should also be broadly interpreted similarly to the definition of "printing" above. Ink is any fluid that can be employed to form an image, figure or pattern by being applied to a print medium, or that can be employed in the processing of a print medium, or that can be employed for the processing of ink (e.g., coagulation or insolubilization of color materials in ink applied to a print medium).

While the invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-018947, filed Jan. 31, 2011, which is hereby incorporated by reference herein in its entirety.

What is claimed is:

1. An image processing method for printing an image onto a print medium using a print head, in which a plurality of print elements are arranged along a first direction, while conveying the print medium in a second direction crossing the first direction relative to the print head, the image processing method comprising:

an obtaining step of obtaining read data by reading a test pattern printed on the print medium using a reading unit;

a detecting step of, (i) in a first case where the test pattern is printed onto the print medium without a margin at side edges of the print medium in the first direction, detecting positions in the read data respectively corresponding to the side edges of the print medium in the first direction, and (ii) in a second case where the test pattern is printed onto the print medium with a margin at the side edges of the print medium in the first direction, detecting positions in the read data respectively corresponding to side edges of the test pattern in the first direction; and a setting step of setting an analytical range of the read data to (i) a range between the detected positions respectively corresponding to the side edges of the print medium in the first case and (ii) a range between the detected positions respectively corresponding to the side edges of the test pattern in the second case.

2. The image processing method according to claim 1, further comprising the steps of:

obtaining luminance information from the read data in the first direction; and determining, (i) in the first case, a region between a position with a luminance higher than a first threshold and a position with a luminance lower than the first threshold as a region corresponding to one of the side edges of the print medium in the first direction and (ii) in the second case, a region between a position with a luminance higher than a second threshold and a position with a luminance lower than the second threshold as a region corresponding to one of the side edges of the test pattern in the first direction.

3. The image processing method according to claim 2, wherein the first threshold is lower than the second threshold.

4. The image processing method according to claim 2, wherein in the first case, the position with the luminance higher than the first threshold is determined to correspond to the print medium, and in the second case, the position with the luminance lower than the second threshold is determined to correspond to the test pattern and the position with the luminance higher than the second threshold is determined to correspond to the margin.

5. The image processing method according to claim 1, wherein a width over which the plurality of print elements can print in the first direction is smaller than the width of the print medium in the first direction.

6. The image processing method according to claim 1, wherein the print medium is read at a position between the reading unit and a member with a luminance lower than the first threshold; and the read data includes data obtained by reading the member.

7. The image processing method according to claim 6, wherein a width of the member in the first direction is greater than a width of the print medium in the first direction.

8. The image processing method according to claim 7, wherein a color of the member is black.

9. The image processing method according to claim 1, further comprising:

a print failure detection step of detecting print failure by the plurality of print elements within the analytical range of the read data set in the setting step.

10. The image processing method according to claim 9, further comprising:

an image generation step of generating image data such that print data to be printed by failed print elements is printed by print elements which can print successfully.

11. The image processing method according to claim 1, wherein the print head includes a first print element array in which a plurality of print elements corresponding to a color material of a first color are arranged and a second print element array in which a plurality of print elements corresponding to a color material of a second color, different from the first color, are arranged, the test pattern includes a first color pattern and a second color pattern, and read data of the first color pattern and read data of the second color pattern are obtained in the obtaining step.

12. The image processing method according to claim 1, wherein the plurality of print elements are inkjet print elements that eject ink.

13. The image processing method according to claim 1, wherein the reading unit is a scanner.

14. An apparatus for printing an image onto a print medium by a print head, in which a plurality of print elements are arranged along a first direction, while conveying the print medium in a second direction crossing the first direction relative to the print head, the apparatus comprising:

an obtaining unit configured to obtain read data by reading a test pattern printed on the print medium;

a control unit configured to:

(i) in a first case where the test pattern is printed onto the print medium without a margin at side edges of the print medium in the first direction, detect positions in the read data respectively corresponding to the side edges of the print medium in the first direction and to set a range between the positions respectively corresponding to the side edges of the print medium as an analytical range of the read data; and (ii) in a second case where the test pattern is printed onto the print medium with a margin at the side edges of the print medium in the first direction, detect positions in the read data respectively corresponding to side edges of the test pattern in the first direction and to set a range between the positions respectively corresponding to the side edges of the test pattern as an analytical range of the read data.

15. An image processing method for printing an image onto a print medium using print head, in which a plurality of print elements are arranged along a first direction, while conveying the print medium in a second direction crossing the first direction relative to the print head, the image processing method comprising:

obtaining read data by reading, by use of a reading unit, a test pattern printed onto the print medium without a margin at side edges of the print medium in the first direction;

detecting positions in the read data respectively corresponding to side edges of the print medium in the first direction; and setting a range between the positions respectively corresponding to the side edges of the print medium as an analytical range of the read data.

16. The image processing method according to claim 15, further comprising:

obtaining luminance information from the read data in the first direction; and determining a region between a position with a luminance higher than a predetermined threshold and a position with a luminance lower than the predetermined threshold as the side edges of the print medium.

17. The image processing method according to claim 16, wherein the position with the luminance higher than the predetermined threshold is determined to correspond to the print medium, and the region with the luminance lower than the predetermined threshold is determined to be outside the print medium.

18. The image processing method according to claim 15, wherein:

the print medium is read at a position between the reading unit and a member with a luminance lower than the predetermined threshold; and the read data includes data obtained by reading the member.

19. The image processing method according to claim 18, wherein a width of the member in the first direction is greater than a width of the print medium in the first direction.

20. The image processing method according to claim 15, further comprising:

a print failure detection step of detecting print failure by the plurality of print elements within the analytical range of the read data set in the setting step.

21. The image processing method according to claim 20, further comprising an image generation step of generating image data such that data to be printed by failed print elements is printed by print elements which can print successfully.

22. An image processing method for printing an image to a print medium using a print head, in which a plurality of print elements are arranged in a first direction, while conveying the print medium in a second direction crossing the first direction relative to the print head, the image processing method comprising:

an obtaining step of obtaining read data by reading a test pattern printed onto the print medium, the read data including (i) first data corresponding to an inner region that is inside of both ends of the print medium along the first direction, and (ii) second data corresponding to an outer region that is outside of both ends of the print medium along the first direction; and an executing step of executing predetermined processing based on the first data.

23. The image processing method according to claim 22, wherein the predetermined processing detects whether a nozzle having an unsatisfactory ejection state is included within print elements, of the plurality of print elements, that are in a region corresponding to the inner region.

24. The image processing method according to claim 22, wherein the predetermined processing is executed without using the second data.

25. The image processing method according to claim 22, further comprising:

a printing step of printing the test pattern onto the print medium using the print head.

26. The image processing method according to claim 22, wherein the test pattern is printed by marginless printing.

27. The image processing method according to claim 22, wherein a brightness of the second data is lower than a brightness of the first data.

28. The image processing method according to claim 22, wherein the outer region corresponds to a roller.

29. The image processing method according to claim 28, wherein a color of the roller is black.

30. An image processing apparatus for printing an image to a print medium using a print head, in which a plurality of print elements are arranged along a first direction, while conveying the print medium in a second direction crossing the first direction relative to the print head, the image processing apparatus comprising:

an obtaining unit configured to obtain read data by reading a test pattern printed onto the print medium, the read data including (i) first data corresponding to an inner region that is inside of both ends of the print medium along the first direction, and (ii) second data corresponding to an outer region that is outside of both ends of the print medium along the first direction; and an executing unit configured to execute predetermined processing based on the first data.

31. An image processing method for printing an image to the print medium using a print head, in which a plurality of print elements are arranged along a first direction, while conveying the print medium in a second direction crossing the first direction relative to the print head, a length of the print medium along the first direction being shorter than a length over which the plurality of print elements are arranged in the first direction, the image processing method comprising:

a printing step of printing a test pattern is printed by marginless printing; and a detecting step of detecting an ejection state of print elements used for printing the test pattern, of the plurality of print elements, based on data obtained by reading the printed test patterns.

32. An image processing apparatus for printing an image to the print medium using a print head, in which a plurality of print elements are arranged along a first direction, while conveying the print medium in a second direction crossing the first direction relative to the print head, a length of the print medium along the first direction being shorter than a length over which the plurality of print elements are arranged in the first direction, the image processing apparatus comprising:

a printing unit configured to cause the print head to print a test pattern by marginless printing onto the print medium; and an obtaining unit configured to obtain ejection state information for print elements used for printing the test pattern, of the plurality of print elements, based on data obtained by reading the printed test pattern.

* * * * *